US008481965B1

(12) United States Patent
Pamfiloff

(10) Patent No.: US 8,481,965 B1
(45) Date of Patent: Jul. 9, 2013

(54) PROCESS FOR THE PRODUCTION OF ELECTRIC ENERGY BY THE EXTRACTION OF ELECTRONS FROM ATOMS AND MOLECULES

(76) Inventor: Eugene B. Pamfiloff, San Anselmo, CA (US)

( * ) Notice: Subject to any disclaimer, the term of this patent is extended or adjusted under 35 U.S.C. 154(b) by 0 days.

(21) Appl. No.: 12/931,752

(22) Filed: Feb. 8, 2011

(51) Int. Cl.
*G21K 5/00* (2006.01)

(52) U.S. Cl.
USPC ..... 250/423 F; 250/423 R; 250/424; 315/111.01; 315/111.81; 315/111.91

(58) Field of Classification Search
USPC ..... 250/423 R, 424, 425, 427, 423 F; 315/111.01, 111.81, 111.91
See application file for complete search history.

(56) References Cited

U.S. PATENT DOCUMENTS

| | | | | |
|---|---|---|---|---|
| 6,688,116 | B1 * | 2/2004 | Schneider et al. | 62/55.5 |
| 2002/0067131 | A1 * | 6/2002 | Nelson | 315/1 |
| 2005/0098720 | A1 * | 5/2005 | Traynor et al. | 250/288 |
| 2005/0269559 | A1 * | 12/2005 | Zhou et al. | 257/10 |

* cited by examiner

*Primary Examiner* — Nicole Ippolito
(74) *Attorney, Agent, or Firm* — Steven A. Nielsen; Allman & Nielsen, P.C.

(57) ABSTRACT

The process of the present application facilitates the production of electric energy by the deliberate extraction of electrons from atoms and molecules of a gas, vapor, liquid, particulate solid, or any other form of matter that can be passed along the surface or through the electron extraction unit. The extracted electrons are captured, collected and controlled or regulated for distribution as electric energy. It is an energy efficient process for the extraction and capture of electrons for the production of electric energy with positive atomic or molecular ions as byproducts. The product ions can then be confined in a coherent beam or restricted to a magnetic enclosure or by other confinement methods, expelled to the atmosphere, another environment or to ground, or modified into useful molecules. These results are accomplished by the forcible extraction and capture of electrons from the object particles by electrically charged particles in a strong electric field. It is an extremely efficient process, in that, once the primary components are sufficiently charged, thereafter it requires only an occasional replenishment of energy to sustain operation.

10 Claims, 15 Drawing Sheets

PROCESS FOR THE PRODUCTION OF ELECTRIC ENERGY BY THE EXTRACTION OF ELECTRONS FROM ATOMS AND MOLECULES

CROSS-REFERENCE TO RELATED APPLICATION

Not Applicable

FEDERALLY SPONSORED RESEARCH

Not Applicable

SEQUENCE LISTING

Not Applicable

BACKGROUND

This application relates to the field of atomic physics and atomic engineering, particularly to the manipulation and control of electrons for the production of electric energy through an efficient and effective process for the extraction of electrons from atoms and molecules.

PRIOR ART

Currently a number of methods are available to produce electric energy; among these are electric generators, alternators, photovoltaic cells, chemical batteries, fuel cells, piezoelectric apparatus, thermoelectric converters and electrostatic devices. All of these involve the conversion of one form of energy into another. Here generators, alternators and piezoelectric devices convert mechanical energy, where specifically, kinetic energy or mechanical strain is thus converted into electrical. The first two require turbines or motors to rotate armatures within magnetic fields, while the third takes advantage of the structural strain within certain crystals. Other systems involve the conversion of chemical energy into electrical as within batteries. Among the electrostatic devices is another mechanical conversion generator called the Van de Graff.

In locations where hydroelectric generation is impractical, electricity is primarily generated by electromechanical means driven by heat engines used to power steam turbine generator apparatus, with the output usually contributing electricity to the local or national power grid. The burning of fossil fuels such as coal, oil, oil products and natural gas feeds these engines and accounts for 83% of the electricity produced in the U.S. Nuclear fission reactors are also used to provide steam to drive power plant turbines. However, the coal, oil, natural gas and nuclear fuels are not renewable and in the coming decades the available supplies will dwindle drastically. Consequently, over the past four decades much effort has been devoted to the development of alternative systems that would make use of renewable energy sources. These would include wind and geothermal generation, river and tidal current generation, and solar energy production. There are two major systems that take advantage of solar energy. A satisfactory output for both systems is restricted to the daylight hours while the sun shines precisely upon the solar components. One consists of the costly photovoltaic cells, which produce electricity directly in small quantity, and the other utilize mirrors to concentrate solar heat energy onto high-pressure steam boilers that in turn power the turbines.

DISADVANTAGES OF PRIOR ART

1. Hundreds of thousands of kilometers of transmission lines are required to connect each building or user to the nationwide power grid.
2. During transmission, there is a substantial loss of electric energy directly from the transmission lines to the atmosphere.
3. Transmission of electricity over great distances requires elaborate substations at specific intervals to maintain the required energy level within the above grade or below grade lines.
4. With conventional equipment there is excessive wear of moving parts within the governor, gearbox, motor or turbine, and generator or alternator.
5. There is excessive wear of moving parts within wind generators that include propeller blade pitch control, speed control governor, gearbox, and generator.
6. The friction developed by the moving parts of the primary generating systems is another negative result with high levels of energy converted into heat rather than electricity.
7. Corrosion of parts and mechanisms of systems powered by hydroelectric means, and those powered by river or tidal currents.
8. All the systems discussed require many years or even decades to recover the initial investments.
9. If nuclear, the expensive materials must be constantly protected and when exhausted as fuel, the radioactive waste must be stored, guarded and monitored indefinitely.
10. Coal-fired power plants produce 40% of atmospheric carbon dioxide as well as other pollutants.
11. Because the commercial solar powered systems require motorized tracking mechanisms for the mirror or the photovoltaic panels, there is a sizeable reduction in the net electric energy produced.
12. For commercial installations to be effective with either solar powered system, the unsightly panel arrays typically occupy vast areas of land.

These are just some of the disadvantages of the current systems. The process of the present application, however, overcomes the previous obstacles.

ADVANTAGES AND SUMMARY

The most idyllic and advantageous electrical system would consist of individual electric power generation units that could be placed upon or near each dwelling, structure or complex making it completely independent from any other electric energy source. It would not contain moving parts that would experience undue wear or parts that would deteriorate over short periods of use. It should efficiently and economically produce electric energy, continuously, twenty-four hours per day, regardless of the weather, and where there was any production in excess of immediate needs could be diverted to the local or national power grid or stored for future use. And if the power generation units were fueled by something other than fossil or nuclear fuels, these features would make it the most practical and environmentally friendly systems. For the first time the technology derived from the present application makes practical such independent power generation units for individual dwellings.

The process can be scaled to accommodate the system energy requirements of most implementations, whether individual homes, multiunit complexes, multistory buildings, factory facilities, neighborhoods and more. Since each dwelling or structure can be individually powered, thousands of kilometers of transmission lines and hundreds of costly substations can be eliminated. It can also accommodate portable power units for use at construction sites or as temporary emergency power stations or even as smaller individual transportable units. The process can be scaled down further to provide power to some appliances or portable devices individually. To accommodate electric automobiles, battery charger units can be placed in many locations including those that are remote. For the production of electric energy the present application represents the first new technology to emerge in several decades.

Electrons extracted from the immediate particulate environment consisting of atoms and molecules fuel the process. And once the system is fully energized, it requires only an infrequent enhancement to sustain operation. The process is further explained below.

Given that the process involves the production of positive ions, a discussion of the prior art related to this subject is presented. Currently, a small number of methods are available to convert electrically neutral atoms or molecules into ions. Neutral atoms contain equal numbers of electrons to the number of protons in the nucleus, while neutral molecules contain electrons in equal numbers to the sum of protons in the discrete nuclei. To ionize a neutral atom or molecule, it is necessary to either add one or more electrons to form a negative ion or knock out one or more electrons to form a positive ion. Ions, for a variety of purposes, have been deliberately produced now for nearly a century. There are several common methods to form negative ions, however, exclusively positive ions are extremely difficult and costly to produce. This is due in part to the high-energy requirements by the current systems that include the continuous application of extreme temperatures during thermal ionization or extremely high voltages continuously applied during coronal discharge. Additional restrictions are imposed by the extremes in the ionization potential or energy requirements to remove the valance or outer electrons of various atoms and molecules. The ionization potential is equal to the binding energy of the electron and is measured in electron volts (eV) or kilojoules per mole. The process of the present application also overcomes these difficulties.

Exposing the target atoms or molecules to either electrical discharge from a cathode in the form of a disk or pointed emitter, or coronal discharge of electrons in a high voltage system usually produces negatively charged ions. Similarly, a variety of electrostatic precipitators are used to place a negative electric charge on larger airborne particles such as dust or pollen. These systems also carry a number of disadvantages that include the consumption of high energy continuously over the course of operation. Another is the occasional production of unwanted ions, those that carry a charge opposite from what a system requires. On occasion, with coronal discharge, for example when negative ions are the objective, an emitted electron will act as a projectile and knockoff or repel an electron from a passing target particle to form the unwelcome positive ion. Through each of the electrostatic methods electrons are emitted to where the successful production of negative ions depends upon the intermittent capture and retention of an electron by a passing atom or molecule. Because the atom or molecule passing the emitter is electrically neutral, it does not attract nor necessarily retain the emitted electron. It is clearly a hit-or-miss situation, resulting with a high percentage of target particles remaining unmodified, and simultaneously being encumbered by the presence of accidental positive ions. However, if the primary objectives of an implementation include an efficient process for the extraction of electrons from atoms and molecules with the continuous production of positive ions, then none of the current methods are suitable.

As previously indicated, the electric generating capabilities of the process of the present application can be used as independent power generation units for individual buildings, small groups of structures or complexes and they can be used to supply vast regions by connecting power units to the national power grid. However, the process is well suited as a charging base for batteries or other electric storage devices. It can also be incorporated into vehicles to provide electric power while they are stationary or underway. This is particularly useful for electric powered vehicles.

DESCRIPTION OF THE PROCESS

The process of the present application differs substantially from the prior art, as it facilitates the production of electric energy by the deliberate extraction of electrons from atoms and molecules of a gas, vapor, liquid, particulate solid, or any other form of matter that can be passed along the surface or through the electron extractor components, see reference numerals. The extracted electrons are collected and controlled or regulated and are available for distribution to various electric devices or storage components. Subject to the implementation, the electric energy could be moved to an inverter where it would be converted to the desired form. It is an energy efficient process for the extraction and capture of electrons for the production of electricity with positive atomic or molecular ions as byproducts. These results are accomplished by the forcible extraction of electrons from the object particles by electrically charged particles in a strong electric field.

The process is superior to any other intended for the extraction and capture of electrons with the production of positive ions because it not only simplifies every implementation or utilization, but it also speeds the operation, allowing a continuous stream or beam of particles to be so manipulated. After ionization, the particles of the stream can then be confined in a coherent beam or restricted to a magnetic enclosure or by other confinement methods, expelled to the atmosphere, another environment or to ground, or modified into useful molecules.

Additionally, the process of the present application demonstrates its superiority to any other because it is extremely efficient, in that, once the system is fully charged thereafter it requires only an occasional replenishment of energy to sustain operation. This is an important feature for any utilization.

It is known that when a parallel plate capacitor is charged and subsequently isolated, it can retain its effective electric charge for an extended period of many months or even many years without degradation. It follows that the positive and negative electric fields produced by such a capacitor will likewise persist for extended periods or until the capacitor is purposely discharged. Exposing the plates of a parallel plate capacitor to an electric potential difference will establish a charge upon them equal to the potential. This involves the removal of electrons from the atoms of one plate with the placement of those electrons onto the opposite plate. Consequently, one plate becomes positively charged due to the shortage of electrons and the other plate becomes negatively charged due to the surplus electrons. This is one of the principles by which the process of the present application functions.

The embodiments contain a conductive component, the electron extractor, on to which a positive electric charge is placed, where one type as part 26*bb* is shown in FIG. 1A. A charged surface of the component is positioned to maximize exposure and contact with the atoms or molecules subject to ionization. These atoms and molecules whose electrons are to be extracted will be referred to as the object or target particles. The charged electron extractor component may be constructed of various conductive materials and in various geometrical configurations, sizes, shapes, arrangements, and quantities. The charged electron extractor component also takes the form of a grid, pane, or panel. Throughout this application the term "grid" will be used to represent a variety of extractor components as may comprise certain embodiments that include but are not limited to the use of screens, lattices, nets, webs, gridirons, gratings, trellises, grills, grids or similar components, or any combination thereof. And the term "pane" will be used to represent a variety of extractor components as may comprise certain additional embodiments that include but are not limited to the use of sectioned or perforated panels, sheets, foil, disks, bars, rods, shafts, tubes, cones, plates, panes or similar components, or any combination thereof. And the term "panel" will be used to represent a variety of extractor components as may comprise certain additional embodiments that include but are not limited to the use of an assembly of non-perforated, sheets, foil, disks, bars, rods, shafts, tubes, cones, plates, panes, or similar components or any combination thereof. The grid, pane, and panel type extractors are defined in greater detail below.

The primary difference between the extractor types relates to the system of contact between the target particles and the extractor. The grid type consists of a conductive material containing mesh openings through which the particles pass. Whereas the pane type consists of a sheet of solid conductive material containing perforations through which the particles pass. And the panel type consists of an assembly of multiple individual non-perforated conductive sheets arranged with gaps in between where along the surface of which the particles pass. The primary objective is to bring the target particles into close proximity to the charged surfaces of the various extractor types and to enhance the probability of contact. Some extractor types as may be used within certain embodiments may be interchangeable, subject to the requirements of the implementation.

The extractors may take many forms and can be manufactured from different conductive materials. The actual materials, geometrical configurations, sizes, shapes, arrangements, and quantities of all components of a system are determined by the specific utilization. Furthermore, the top and bottom of a grid or other extractor type may be shaped to conform to the shape of a negative or positive field plate. For example, if, as seen from an end view, the field plate, part 22 of FIG. 1A, is curved, the top of the grid, part 26*bb* of FIG. 1A, would match that contour. Multiple extractors are operated individually as a group or as many groups as are necessary, by which or through which the object atoms and molecules are directed. However, when single or multiple extractor components are part of an assembly containing a negative field plate or as applicable, include a positive field plate, they will be referred to collectively as the electron extraction unit (EEU) of a type subject to the embodiment or the specific implementation.

A positive electric charge is placed upon the extractor, where specifically the applied charge is sufficient to influence the valance electrons within a percentage of the atoms of the conductive material. For example, 60 percent of the atoms are encouraged to give up one electron, whereby the resultant positive charges will distribute evenly throughout the surface of the material. However, a +1 or greater net charge per atom can also be placed on the material, indicating the removal of one or more valence electrons from each atom. The, now, positively charged atoms will attract and forcibly extract electrons from any atom or molecule that closely approaches or comes into contact with the grid, pane or panel material of the electron extractor component.

Other embodiments may utilize a grid type extractor assembly with one grid to extract the first electron from the object particle, a second grid for the second electron and a third grid for the third electron, and so on. Each successive grid may have different opening sizes and shapes to facilitate the molecule as it passes from one to the other. Additional control is gained by placing differing levels of charge from one grid to the other. Also, a constantly varying or alternating charge on single or multiple grids could be applied subject to the requirements of an implementation or utilization. In another embodiment, the object atoms or molecules could be re-circulated through a single grid held at either a constant net charge or a varying net charge to facilitate the extraction of additional electrons.

Summarizing the previous discussion, because the number of valance electrons is known and varies with different materials, within certain limits the net average charge per atom of the grid, pane or panel can be controlled. Referring specifically to the grid or pane type extractors, additional control is obtained by adjustment of the thickness of the material, type of material and the shape and opening dimensions of mesh or perforations in relation to the size of the object atom or molecule. Additional control is gained through adjustable aperture sizes in height, width and depth and with shapes adjusted to maximize results for specific object atoms or molecules. Further controls are obtained by controlling the angle of the grid face and the aperture openings relative to the direction of the target particle flow. One, two, or multi-dimensional angular control of the panel type, pane type or grid type extractor can be applied to substantially increase the probability of direct contact. Direct contact with the extractor material substantially increases the probability of extracting at least one electron from the object particle. The quantity of electrons and the ease with which they can be removed from an atom or molecule is subject to the particle's ionization potential. Moreover, by the strict control of the variables described herein, including the average net positive charge per atom on the electron extractor, selectively, one or more electrons can be extracted per target atom or molecule. This has far reaching consequences, as subsequently described.

The required net positive charge is applied to the extractor by a strong negative electric field produced by the electric potential difference, just as that between the plates of a parallel plate capacitor powered by a power source. In other embodiments, a strong magnetic field will have a similar effect with respect to placing a net charge on the extractor material. Likewise, in another embodiment a combination of electric and magnetic fields can be applied for this purpose. In some embodiments the extractor assembly takes the place of one of the field plates of the capacitor, actually becoming the positive field plate, as in FIG. 1A.

Once the capacitor field plates are fully charged and the valance electrons are expelled from the extractor material, thereafter the system requires only an occasional energy supplement to maintain the effectiveness of its operation.

A close encounter or direct contact between the positively charged surface of the extractor and the neutral target atoms or molecules results in the forcible extraction and capture of their electrons, thus producing positive ions. The strong negative electric field established upon field plate 22 repels both the valence electrons of the grid atoms and those electrons captured by the grid atoms. This applies to other types of extractors. The negative electric field drives the electrons toward the positive component that simultaneously attracts.

The electrons are thus expelled from the grid to locations to where their return can be restricted by a valve. In those locations, they are held to maintain the electric field or for additional manipulation or stored for later utilization as electric energy. The captured electrons can also be used in some applications to power certain devices directly. By controlling the quantity of positive charges within the extractor material, the size and shape of the openings, perforations or gaps and the thickness of the material, electrons can be forcibly extracted from a continuous stream of target particles, such as those that comprise air. As can be seen, the present process is innovative in the capture and collection of electrons for the production of electric energy, demonstrating its superiority to any prior art.

DRAWINGS

Figures

Described below are representations of several basic embodiments for which the designations are not indicative of any specific order or preference over any other embodiment. In the drawings, closely related figures have the same alphabetic suffix but different numbers.

Figure 1A:
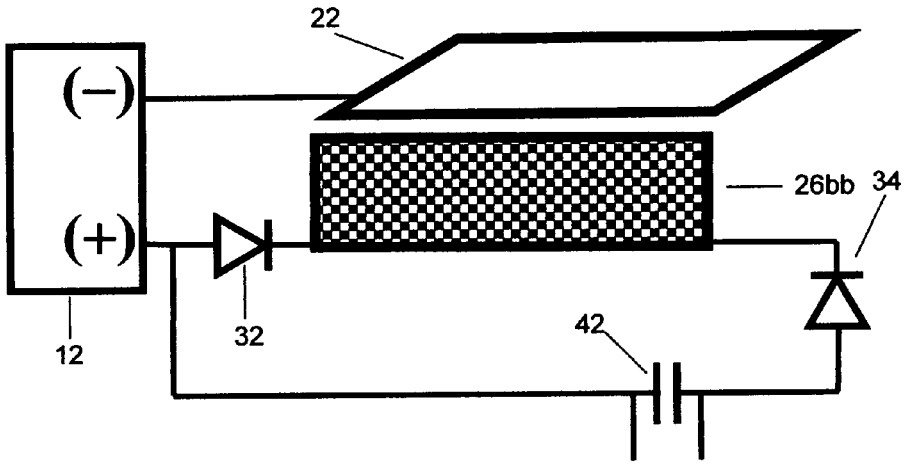
FIG. 1A shows one variation of an embodiment containing two valves and a single grid type electron extractor, where extracted electrons are directed to a collector.

The figures described above are for purposes of explanation of the process and are not drawn to any relative or absolute scale. Furthermore, the actual size, shape and design of the parts are not absolute but rather are subject to the implementation.

DRAWINGS

Reference Numerals

12 Power source
22 Negative field plate
24 Positive field plate
26*aa* Grid type extractor
26*ab* Second grid type extractor
26*ac* Third grid type extractor
26*ag* Grid type extractor assembly
26*bb* Grid type positive field plate
26*bc* Second grid type positive field plate
26*bd* Third grid type positive field plate
26*bg* Grid type positive field plate assembly
26*cc* Pane type extractor
26*cb* Pane type positive field plate
28*a* Panel type extractor
28*b* Panel type positive field plate
32 Valve assembly, represented by a diode
34 Valve assembly, represented by a diode
36 Valve assembly, represented by a diode
38 Valve assembly, represented by a diode
42 Charge collector
44 Ion diverter
46 Diverter charge plate
52 Charge control unit
62 Electric storage unit
72 Electric inverter unit

DETAILED DESCRIPTION

FIGS. 1A, 2A, 3A, 4A, 5A, 6A and 7A—Variations of an Embodiment

DESCRIPTION

FIG. 1A

FIG. 1A shows one variation of the basic components of an embodiment coupled with a schematic diagram indicating their relative position within an electronic circuit. The components include a power source, part 12, with the negative terminal connected to the negative field plate, part 22, while the positive terminal is connected to the grid, part 26*bb*. The parts 22 and 26*bb* are in fact the negative and positive plates of a parallel plate capacitor, respectively. In this embodiment the grid is a dual function positive field plate and grid type extractor resulting in part 26*bb*.

As shown, the grid type positive field plate 26*bb* is connected through valve 32 to the power source 12 and through valve 34 to the charge collector, part 42. The valves prevent the return of electrons to the grid. Both valves are represented by diodes although many types of valves can be used. The positive terminal of part 42 also connects to the power source 12. Just as with the grid, when the power source is activated, electrons are removed from the positive terminal of the collector 42 and transferred to the negative field plate, part 22.

The positive charge established there attracts extracted electrons to the opposite or negative terminal of the collector 42. Although a single collector is shown, it is representative of a group consisting of any quantity that may be required by an implementation. The electric energy consolidated on the negative side of the collector 42 can now be distributed to many devices directly or put to use as may be necessary.

OPERATION

FIG. 1A

In a charging parallel plate capacitor connected to a power source, electrons will move from the positive field plate and accumulate upon the negative field plate. These electrons that are easily moved about are the valance or outer most electrons in the atoms of the field plate material. Likewise, here in FIG. 1A, the process involves a voltage potential difference to be placed upon the conductive field plates, parts 22 and 26*bb*. The atoms of the dual function grid type positive field plate experience a loss of electrons and consequently the grid exhibits a strong positive electric field. While simultaneously those electrons accumulate upon the negative field plate 22 thus producing a strong negative electric field that consistently maintains the repulsion and evacuation of valance and subsequent extracted electrons from the atoms of the grid. The positively charged atoms of the grid do more than just extract electrons from target particles, they also capture the extracted electrons. As the valance electrons are being evacuated from the grid 26*bb*, they are also being evacuated from the positive side of the collector 42. Initially, the valance electrons of the grid will move through valve 32 through the power source 12 and to the negative field plate 22. This continues until the field plate 22 is saturated, where then the power source 12 responds accordingly by entering into a standby state whereby the remaining valance electrons and the subsequent extracted electrons will move through valve 34 and accumulate on the negative side of the charge collector 42 or group thereof. Those remaining valance and the extracted electrons are attracted to the collector by the strong positive charge placed upon the opposite plate. At this point, the power source 12 remains in standby to replenish the charge on the negative field plate 22. The circuit activates only if the charge on the field plate 22 should degrade, whereby the electric energy will be supplied from the subsequent captured electrons through valve 32 or supplied through other components such as the collector 42 or the inverter 72, subject to the implementation.

The quantity of repelled valance electrons is regulated by the strength of the electric field placed upon the field plates, parts 22 and 26*bb*. Due, in part, to the expelled valance electrons nearest the negative field plate 22, subsequent electrons of the grid atoms are repelled, while simultaneously being attracted to the positive terminal. These events leave a strong positive charge throughout the grid. The valance electrons are prevented from returning to the grid by the valves 32 and 34. Once the field plates are charged, energy consumption by the power source 12 reduces substantially to a negligible quantity, which will be applied thereafter infrequently and only if the charge on the negative field plate should degrade. To prevent arcing and degradation of the negative electric field, the field plate 22 is typically isolated from the ambient environment, the target particles, the product particles, and from the extractor components, subject to the specific utilization. The field plate is isolated from the grid with either a sufficient gap or with a minimal and suitable nonconductive barrier, for example, or both. But nevertheless, to maximize the effect of the negative electric field the two components, 22 and 26*bb*, are placed as close as possible to each other.

The choice of material for the electron extractor is influenced by many factors, one being the primary objective of a chosen implementation and another relates to the type of electron extractor to be employed.

Now, depending upon the embodiment or implementation, as the target particles are guided through the grid apertures, every close encounter or direct contact with any part of the positively charged grid results in the forcible extraction of their valance electrons, the number being influenced by the net charge per atom of the grid. Each atom of the grid that has given up one or more electrons will seize and forcibly extract and capture electrons at every opportunity from every particle passing in close proximity. Obviously, the atom or molecule subject to ionization could easily come into direct contact with two, three, or more of the grid atoms during a single encounter. Accordingly, that single encounter could result in the extraction of multiple electrons. The target atom or molecule thus becomes a +1 or greater positive ion, which can now be controlled and manipulated for various purposes by an imposed electric field. Here, once again, the extracted and captured electrons are repelled by the negative field plate 22 and attracted to the charge collector unit or multiple units by the established positive charge of the opposite collector plate.

If at any time the negative field plate 22, should suffer a loss of electrons and thereby experience a reduction in the negative electric field, it will be routinely replenished to the preexisting or preset level or until fully saturated again with electrons extracted by the EEU, which are transferred through the power source 12. The negative field plate should remain isolated from the ambient environment and from the target particles moving through the grid and the product particles exiting the grid unless a particular embodiment or implementation requires otherwise.

Figure 5A:
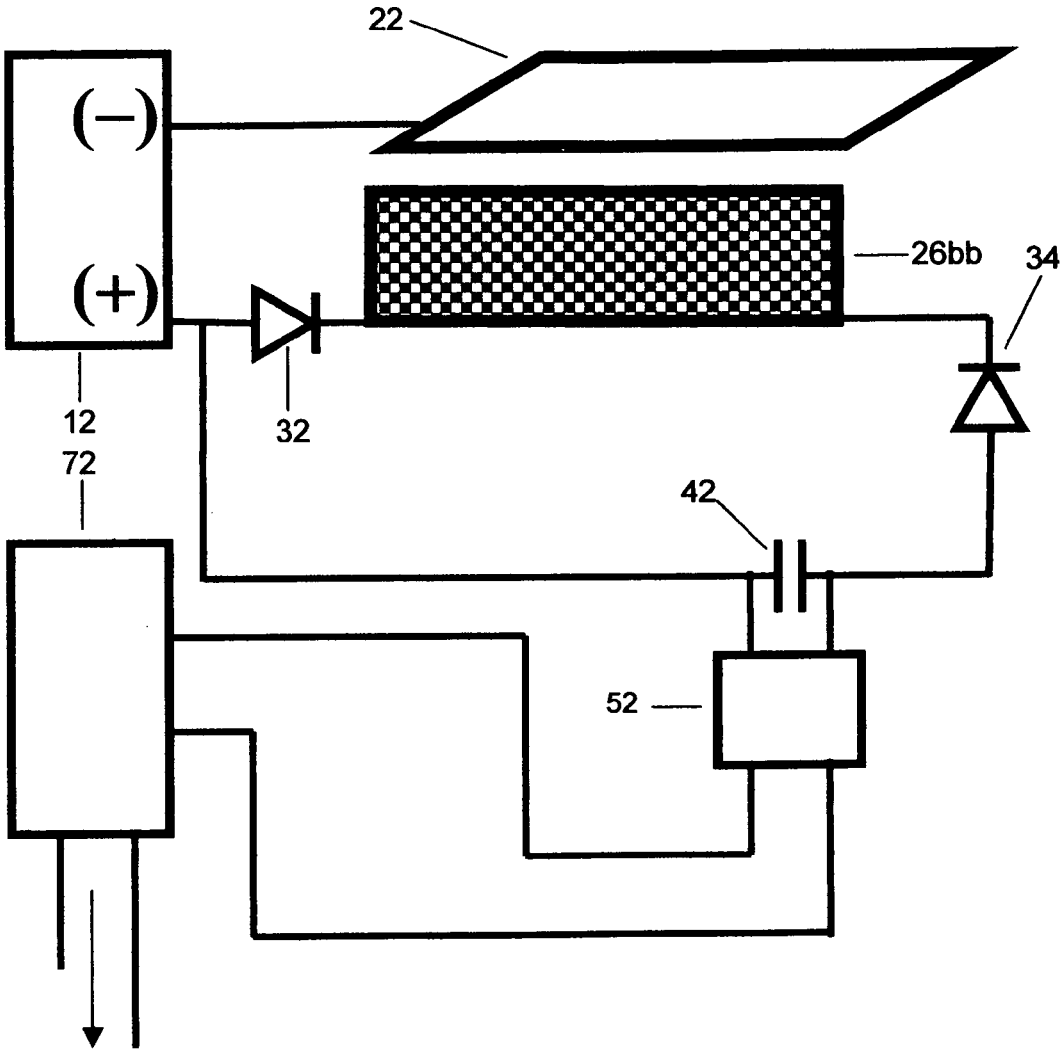
FIG. 5A shows another variation of the embodiment containing two valves with a single grid type extractor, a charge control unit and an inverter.
Figure 5C:
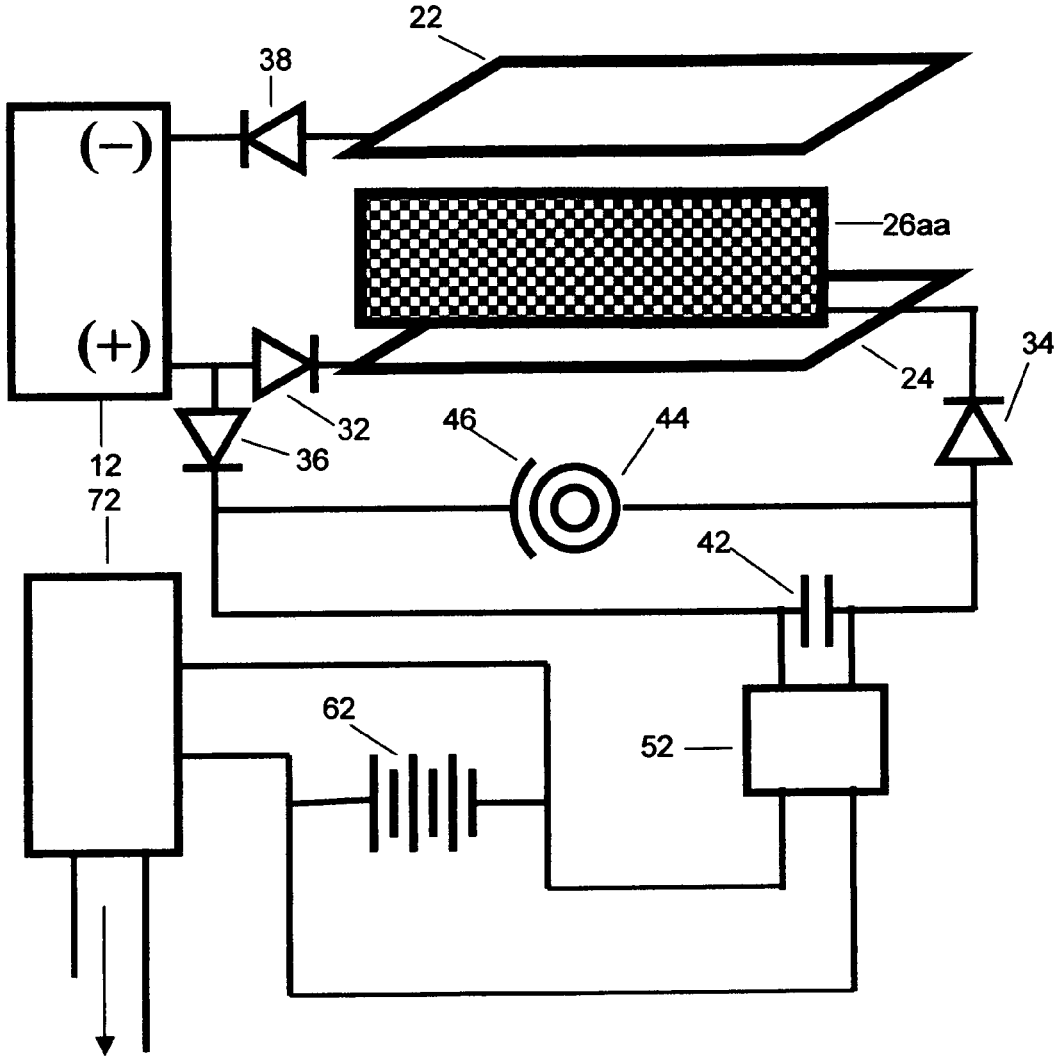
FIG. 5C shows another variation of the embodiment containing the components listed in the previous figure with the addition of an ion diverter.

Now, if the system is placed in the presence of a gas, vapor or cloud of particulate solids, or in an environment saturated by air, for example where as the particles of air near the grid lose their valance electrons and convert to positive ions they are in turn attracted by an external component with a bias voltage, an ion diverter as shown in FIG. 5C or other device that attracts, expels or moves the object particles.

Through various means a continuous flow of the gas through the grid is established. However, there are many methods to establish a flow of particles through the grid. It should be expressed that the various embodiments do not necessarily require an ion diverter (attraction through an electric field), or particle accelerator to bring about the movement of air or of another gas through the EEU grid. Since the target particle becomes charged or ionized at the instant it passes into the grid aperture, only then does it become susceptible to electric or magnetic fields intended to cause a flow. Actually there are many alternatives to either push or pull electrically neutral particles or charged ions through an electron extraction unit. For example any of the following can be applied: a) the natural flow of exterior air currents; b) a solar powered fan; c) electric powered fan; d) temperature inversion; e) magnetic attraction; f) electromagnetic attraction; g) magnetic repulsion; h) electromagnetic repulsion; i) electric field repulsion; j) compressed gas; k) pressurized gas or liquid; l) gravitational attraction; m) electromagnetic waves; n) nuclear emissions; o) pressure difference.

In fact, the process of the present application does not require an ion accelerator, although one could be used in some implementations. At the instant that an electron is extracted from a passing target particle, it becomes positively charged and spontaneously repels from the positively charged grid that ionized it. Its expulsion thus produces a partial vacuum and in-turn a natural movement through the grid of those as yet unionized target particles follow.

In the figure a single electron extraction grid, part 26*bb*, is shown, however, it should be understood that it represents one or more grid units or groups of units, or any number that may be required by a utilization.

In the figure a single charge collector, part 42, is shown, however, it should be understood that it represents one or more collectors or groups of collectors, or any number that may be required by a utilization.

The previous statement also refers to the other components as well, for wherever one component is shown, it should be understood that it represents one or more component units, or groups of units, or any number that may be required by a utilization.

It should also be understood that subject to the requirements of a specific embodiment or implementation, common electronic components that may not be expressly shown in the figures are nevertheless represented as part of the block components.

As previously stated, the figures show the components and their relative position within an electronic circuit, however, the actual style, shape, size, value, configuration, design and specification of each part is determined by its final execution and relation to adjoining parts and components.

It should be noted that although in the various embodiments two, three or four valves are shown, they are representative of a group consisting of any quantity that may be required at any specific position or throughout the circuitry of an implementation.

As can be seen, by maintaining the respective electric charge upon the negative field plate 22, the positive grid 26*bb* and the positive side of the collector 42 and placing the embodiment in an environment containing air or other gas, a continuous supply of electric energy is produced, collected and made ready for use in a variety of systems.

In each of the following FIGS. 2A through 7A, the sequence of operation described above is similar, although additional components are added.

DESCRIPTION

FIG. 2A

Figure 2A:
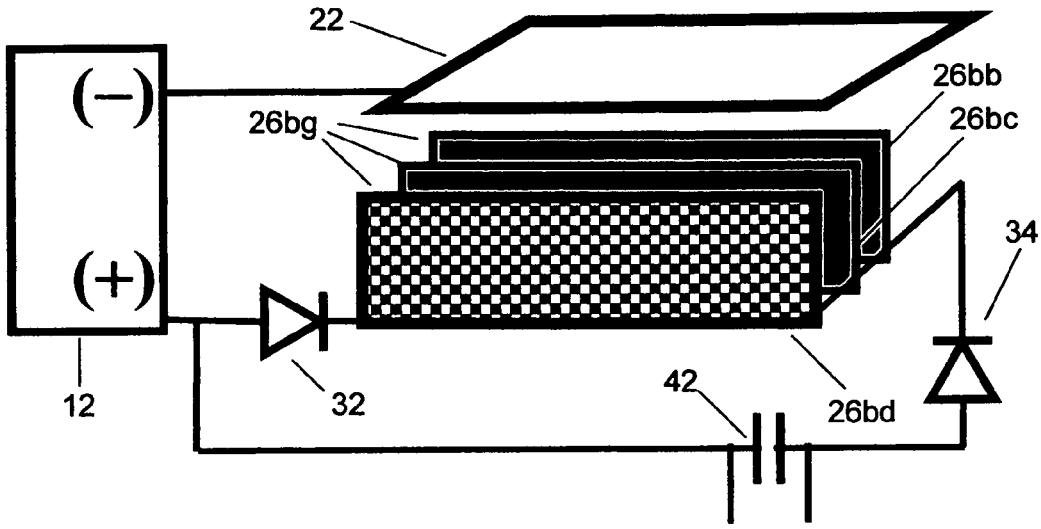
FIG. 2A shows another variation of the embodiment with a grid type electron extractor assembly containing three grids.

FIG. 2A shows another variation of the basic components of the previous embodiment coupled with a schematic diagram indicating their relative position within an electronic circuit. The components include a power source, part 12, which is connected to the negative field plate, part 22. Through the other terminal, the power source is connected to the grid type positive field plate assembly, part 26*bg*, a multi-grid electron extraction assembly that substantially increases the capacity to ionize particles and produce free electrons. The grid is connected to two valves that include, part 32, which connects the grid assembly, part 26*bg*, to the power source, part 12, while the valve, part 34, also connects the grid 26*bg* to the charge collector, part 42. Both valves are represented by diodes. The power source, part 12, also connects to the positive terminal of the collector, part 42. The positive charge established there attracts the extracted electrons to the negative terminal of the collector. This figure differs from the previous by the addition of a three-grid assembly in place of the single grid of FIG. 1A.

OPERATION

FIG. 2A

The basic operation of FIG. 2A is as that of the previous figure. From the perspective shown, the target atoms and molecules of air or other gas are guided to the backside of grid 26*bb* and continue through it and grid 26*bc* and exit through the front of grid 26*bd* as ions. While the target particles are passing through the grids, the close encounter or contact with the atoms of the grid material results in the extraction and capture of one or more electrons. The captured electrons are in turn repelled from the grid atoms by the strong negative electric field imposed by the field plate 22. Simultaneously the positive side of the collector 42 attracts the captured electrons, where they accumulate on the negative side, being unable to return to the grid. Considering that the collector 42 represents any number that may be required, a substantial quantity of energy can accumulate over very short periods of time. The energy is thus immediately available for use in a variety of applications. As can be seen, by maintaining the respective electric charge upon the negative field plate 22, the positive grid assembly 26*bg* and the positive side of the collector 42 and placing the embodiment in an environment containing air or other gas that moves through the grid, a continuous supply of electric energy is produced, collected and made ready for use in a variety of systems. Additionally, the process functions as described above in FIG. 1A.

DESCRIPTION

FIG. 3A

Figure 3A:
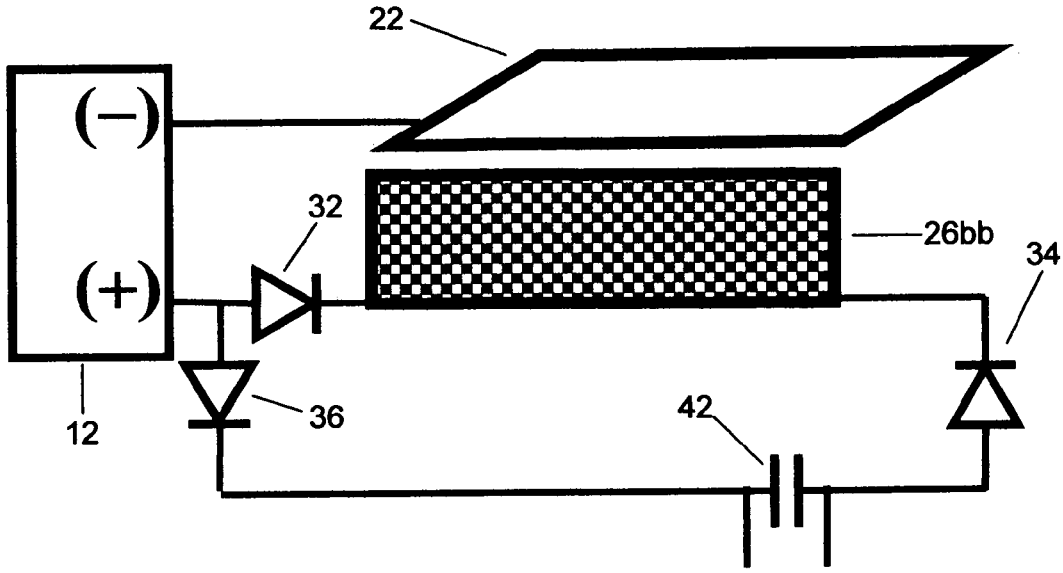
FIG. 3A shows another variation of the embodiment with a third valve but with a single grid type extractor.

FIG. 3A shows another variation of the basic components of the previous embodiment coupled with a schematic diagram indicating their relative position within an electronic circuit. The components include a power source, part 12, which is connected to the negative field plate, part 22. Through the other terminal, the power source is connected to the grid type positive field plate, part 26*bb*, a single grid type electron extractor with the capacity to ionize particles and produce free electrons. The grid is connected to two valves that include, part 32, which connects the grid, part 26*bb*, to the power source, part 12, while the valve, part 34, also connects the grid 26*bb* to the negative side of the charge collector, part 42. The power source 12 also connects to the positive terminal of the collector 42 through a third valve, part 36. All three valves are represented by diodes. The positive charge established on the positive side attracts the captured electrons to the negative terminal of the collector 42. This figure differs from FIG. 2A by the addition of a third valve, which prevents the return of electrons to the positive terminal of the collector 42.

OPERATION

FIG. 3A

The basic operation of FIG. 3A is as that of the previous figure. From the perspective shown, the target atoms and molecules of air or other gas are guided to the backside of grid 26*bb* and exit through the front as ions. While the target particles are passing through the grid, the close encounter or contact with the atoms of the grid material results in the extraction and capture of one or more electrons. The captured electrons are in turn repelled from the grid atoms by the strong negative electric field imposed by the field plate 22. Simultaneously the positive side of the collector 42 attracts the captured electrons, where they accumulate on the negative side, being unable to return to the grid. The valve 36, situated between the collector 42 and the power source 12, prevents the return of electrons to the positive terminal of 42, thus preserving the positive charge and effectiveness of the collector. Considering that the collector 42 represents any number that may be required, a substantial quantity of energy can accumulate over very short periods of time. The energy is thus immediately available for use in a variety of applications. As can be seen, by maintaining the respective electric charge upon the negative field plate 22, the positive grid 26*bb* and the positive side of the collector 42 and placing the embodiment in an environment containing air or other gas that moves through the grid, a continuous supply of electric energy is produced, collected and made ready for use in a variety of systems. Additionally, the process functions as described above in FIG. 1A.

DESCRIPTION

FIG. 4A

Figure 4A:
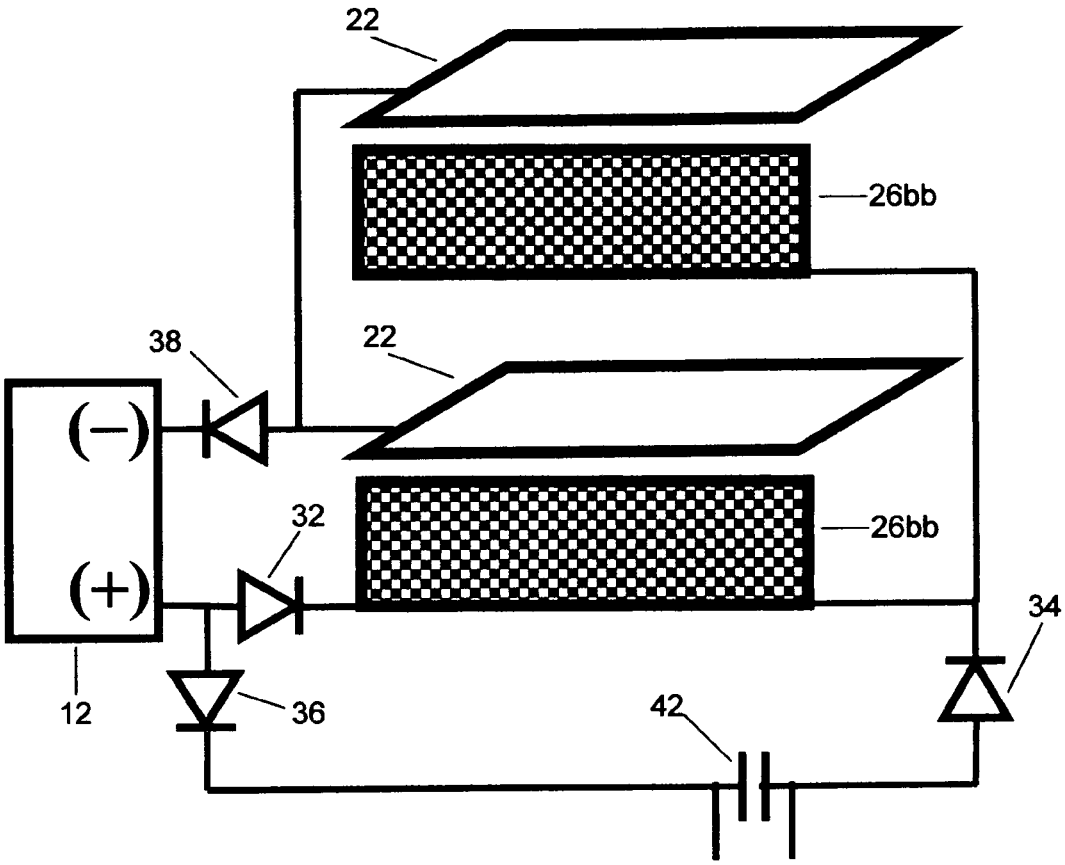
FIG. 4A shows another variation of the embodiment containing four valves and two grid type electron extractors as part of the independent electron extraction units.

FIG. 4A shows another variation of the basic components of the previous embodiment coupled with a schematic diagram indicating their relative position within an electronic circuit. The components include a power source, part 12, which is connected through valve 38 to the two negative field plates, part 22. Through the other terminal, the power source is connected to the two grid type positive field plates, part 26*bb*, each a single grid type electron extractor with the capacity to ionize particles and produce free electrons. The grids are connected to two valves that include the valve, part 32, which connects the grids, part 26*bb*, to the power source, part 12, while the valve, part 34, connects the grids to the negative side of the charge collector, part 42. The power source 12 also connects to the positive terminal of the collector, part 42 through valve, part 36. All four valves are represented by diodes. The positive charge established on the positive side attracts the captured electrons to the negative terminal of the collector 42. This figure differs from FIG. 3A by the addition of a fourth valve, which prevents the escape of electrons from the negative field plates 22 to the power source and the addition of a second grid type EEU.

OPERATION

FIG. 4A

The basic operation of FIG. 4A is as that of the previous figure. From the perspective shown, the target atoms and molecules of air or other gas are guided to the backside of grids 26*bb* and exit through the front as ions. While the target particles are passing through the grids, the close encounter or contact with the atoms of the grid material results in the extraction and capture of one or more electrons. The captured electrons are in turn repelled from the grid atoms by the strong negative electric field imposed by the field plate 22. Simultaneously the positive side of the collector 42 attracts the captured electrons, where they accumulate on the negative side, being unable to return to the grids. The valve 36, situated between the collector 42 and the power source 12 prevents the return of electrons to the positive terminal of 42, thus preserving the positive charge and effectiveness of the collector. Considering that the collector 42 represents any number that may be required, a substantial quantity of energy can accumulate over very short periods of time. The addition of the second electron extraction unit (EEU), consisting of parts 22 and 26*bb*, demonstrates that any number that may be required by an implementation can be applied. The energy is thus immediately available for use in a variety of applications. As can be seen, by maintaining the respective electric charge upon the negative field plates 22, the positive grids 26*bb* and the positive side of the collector 42 and placing the embodiment in an environment containing air or other gas that moves through the grid, a continuous supply of electric energy is produced, collected and made ready for use in a variety of systems. Additionally, the process functions as described above in FIG. 1A.

DESCRIPTION

FIG. 5A

FIG. 5A shows another variation of the basic components of the previous embodiment coupled with a schematic diagram indicating their relative position within an electronic circuit. The components include a power source, part 12, which is connected to the negative field plate, part 22. Through the other terminal, the power source is connected to the grid type positive field plate, part 26*bb*, a single grid type electron extractor with the capacity to ionize particles and produce free electrons. The grid is connected to two valves that include, part 32, which connects the grid 26*bb* to the power source 12, while the valve, part 34, connects to the charge collector, part 42. Both valves are represented by diodes. The power source, part 12, also connects to the positive terminal of the collector, part 42. The positive charge established there attracts the extracted electrons to the negative terminal of the collector 42. With the addition of the charge control unit, part 52, the electric energy accumulated by the collector 42 can be distributed in the required quantity. As shown here the control unit 52 distributes the energy to the inverter, part 72. The inverter 72 converts the electric energy into the required form, specifically the voltage and as necessary the required frequency, for example, 120V at 60 Hz. This figure differs from the previous by the addition of the components, the charge control unit, part 52 and the inverter unit, part 72.

OPERATION

FIG. 5A

The basic operation of FIG. 5A is as that of the previous figure. From the perspective shown, the target atoms and molecules of air or other gas are guided to the backside of grid 26*bb* and exit through the front as ions. While the target particles are passing through the grid, the close encounter or contact with the atoms of the grid material results in the extraction and capture of one or more electrons. The captured electrons are in turn repelled from the grid atoms by the strong negative electric field imposed by the field plate 22. Simultaneously the positive side of the collector 42 attracts the captured electrons, where they accumulate on the negative side, being unable to return to the grid. Considering that the collector 42 represents any number that may be required, a substantial quantity of energy can accumulate over very short periods of time. As shown here the control unit 52 distributes the energy to the inverter unit 72. The inverter 72 converts the electric energy into the required form. For example, direct current (DC) can be converted to a required voltage and frequency such as 120V alternating current (AC) at 60 Hz.

The energy is thus immediately available for use in a variety of applications. As can be seen, by maintaining the respective electric charge upon the negative field plate 22, the positive grid 26*bb* and the positive side of the collector 42 and placing the embodiment in an environment containing air or other gas that moves through the grid, a continuous supply of electric energy is produced, collected and made ready for use in a variety of systems. Additionally, the process functions as described above in FIG. 1A.

DESCRIPTION

FIG. 6A

Figure 6A:
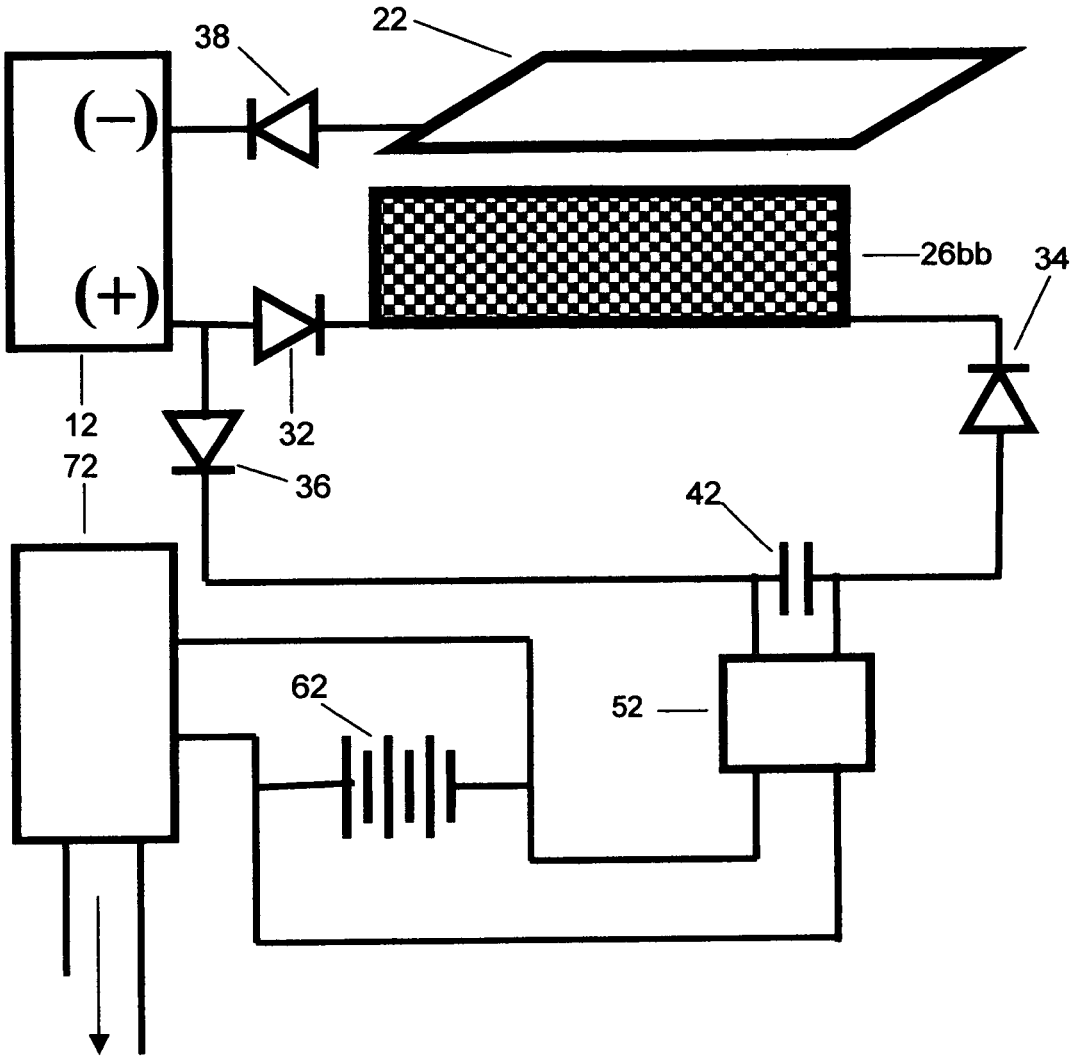
FIG. 6A shows another variation of the embodiment containing four valves with a grid type electron extraction unit, a charge control unit, an inverter and an electric storage device has been added.

FIG. 6A shows another variation of the basic components of the previous embodiment coupled with a schematic diagram indicating their relative position within an electronic circuit. The components include a power source, part 12, which is connected through valve, part 38, to the negative field plate, part 22. Through the other terminal, the power source is connected to the grid type positive field plate, part 26*bb*, a single grid type electron extractor with the capacity to ionize particles and produce free electrons. The extractor is connected to two valves that include, part 32, which connects the grid 26*bb* to the power source 12, while the valve, part 34, connects it to the charge collector, part 42. Both valves are represented by diodes. The power source, part 12, also connects through valve, part 36, to the positive terminal of the collector, part 42. The positive charge established there attracts the extracted electrons from the grid to the negative terminal of the collector 42. With the addition of the charge control unit, part 52, the electric energy accumulated by the collector 42 can be distributed in the required quantity. As shown here the control unit 52 distributes the energy to the inverter, part 72. The inverter 72 converts the electric energy into the required form, specifically the voltage and as necessary the required frequency. To increase storage capacity, an electric storage unit, part 62, has been added. This figure differs from the previous by the addition of the components, valves 36 and 38 and the electric storage unit 62.

OPERATION

FIG. 6A

The basic operation of FIG. 6A is as that of the previous figure. From the perspective shown, the target atoms and molecules of air or other gas are guided to the backside of grid 26*bb* and exit through the front as ions. While the target particles are passing through the grids, the close encounter or contact with the atoms of the grid material results in the extraction and capture of one or more electrons. The captured electrons are in turn repelled from the grid atoms by the strong negative electric field imposed by the field plate 22. Simultaneously the positive side of the collector 42 attracts the captured electrons, where they accumulate on the negative side, being unable to return to the grid. Considering that the collector 42 represents any number that may be required, a substantial quantity of energy can accumulate over very short periods of time. The addition of valve 36 prevents the return of electrons to the positive terminal of the collector 42. Similarly, the addition of valve 38 prevents the electrons established upon the negative field plate 22 from returning to the power source 12. As shown here the control unit 52 distributes the collected energy to the inverter unit 72. However, an electric storage unit 62 has been added to increase the capacity. Although a single electric storage unit 62 is shown, it is representative of a group consisting of any quantity that may be required by an implementation. The inverter 72 converts the electric energy into the required form. For example, direct current (DC) can be converted to a required voltage and frequency such as 120V alternating current (AC) at 60 Hz. The energy is thus immediately available for use in a variety of applications. As can be seen, by maintaining the respective electric charge upon the negative field plate 22, the positive grid 26*bb* and the positive side of the collector 42 and placing the embodiment in an environment containing air or other gas that moves through the grid, a continuous supply of electric energy is produced, collected and made ready for use in a variety of systems. Additionally, the process functions as described above in FIG. 1A.

DESCRIPTION

FIG. 7A

In several of the subsequent figures a pane type extractor is shown in place of the grid type previously shown. The pane type extractor consists of a sheet of conductive material containing perforations through which the target particles must pass. The pane type extractor may be a single function 26 cc component or dual function pane type positive field plate 26*cb* component.

Figure 7A:
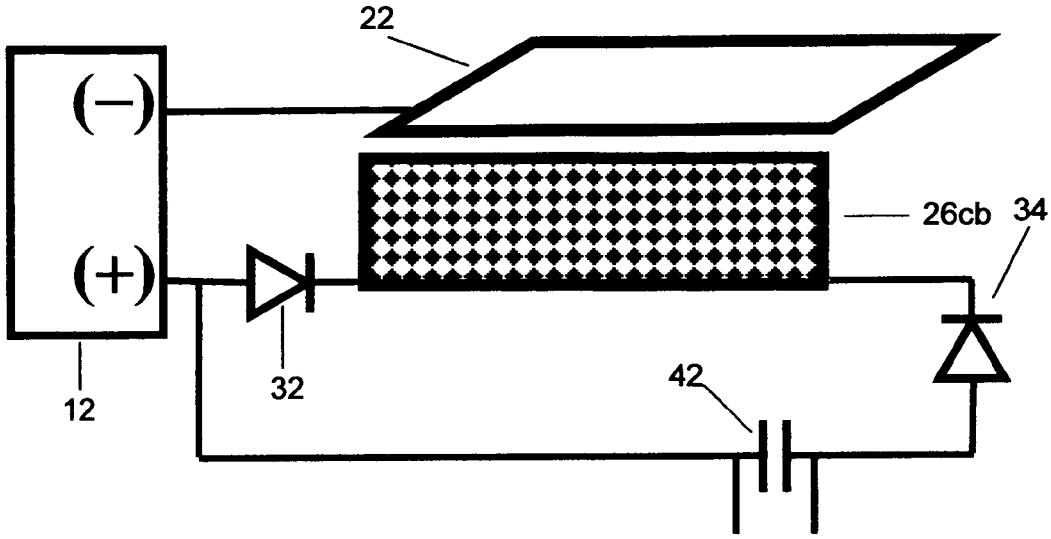
FIG. 7A shows another variation of the embodiment containing two valves and a pane type electron extractor.

FIG. 7A shows another variation of the basic components of the previous embodiment coupled with a schematic diagram indicating their relative position within an electronic circuit. The components include a power source, part 12, which is connected to the negative field plate, part 22. Through the other terminal, the power source is connected to the pane type extractor positive field plate, part 26*cb*, a single pane type electron extractor with the capacity to ionize particles and produce free electrons. The pane is connected to two valves that include, part 32, which connects the pane, part 26*cb*, to the power source, part 12, while the valve, part 34, also connects the pane 26*cb* to the charge collector, part 42. Both valves are represented by diodes. The power source, part 12, also connects to the positive terminal of the collector, part 42. The positive charge established there attracts the extracted electrons to the negative terminal of the collector. This figure differs from FIG. 1A with a single pane type positive field plate extractor 26*cb* in place of the single grid type.

OPERATION

FIG. 7A

The basic operation of FIG. 7A is as that of the previous figure. From the perspective shown, the target atoms and molecules of air or other gas are guided to the backside of pane 26*cb* and exit through the front as ions. While the target particles are passing through the pane, the close encounter or contact with the atoms of the pane material results in the extraction and capture of one or more electrons. The captured electrons are in turn repelled from the atoms of the pane by the strong negative electric field imposed by the field plate 22. Simultaneously the positive side of the collector 42 attracts the captured electrons, where they accumulate on the negative side, being unable to return to the pane. Considering that the collector 42 represents any number that may be required, a substantial quantity of energy can accumulate over very short periods of time. The energy is thus immediately available for use in a variety of applications. As can be seen, by maintaining the respective electric charge upon the negative field plate 22, the positive pane 26*cb* and the positive side of the collector 42 and placing the embodiment in an environment containing air or other gas that moves through the pane, a continuous supply of electric energy is produced, collected and made ready for use in a variety of systems. Additionally, the process functions as described above in FIG. 1A.

DETAILED DESCRIPTION

Figure 1B:
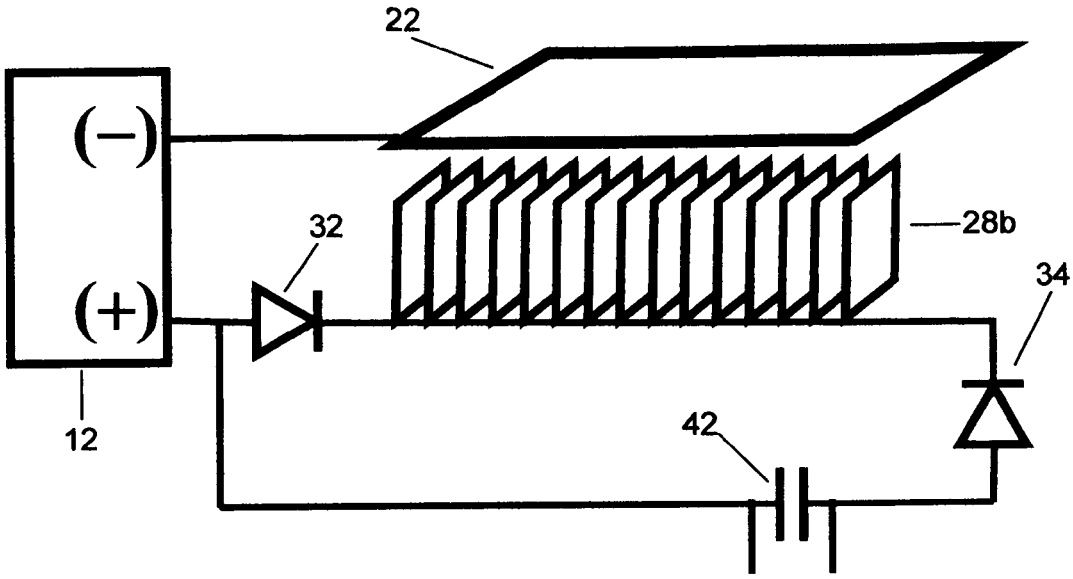
FIG. 1B shows one variation of another embodiment containing two valves and a single panel type electron extractor.
Figure 2B:
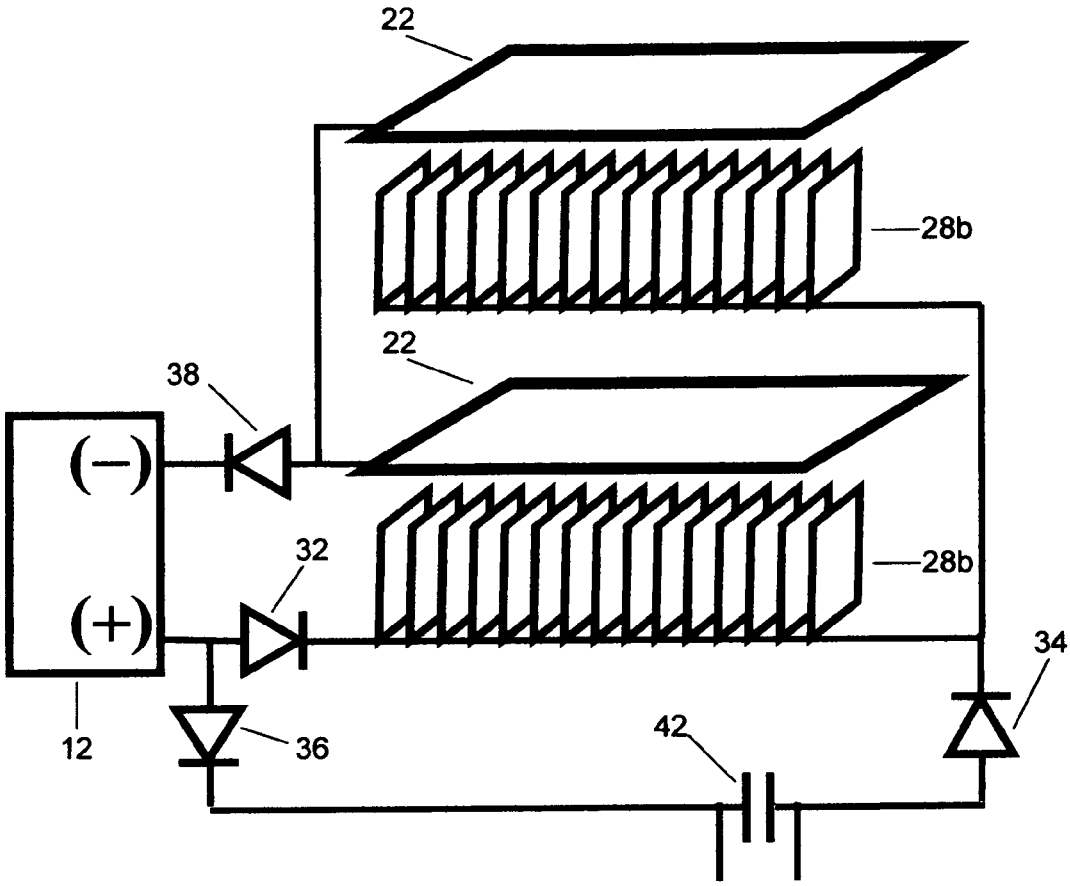
FIG. 2B shows another variation of the embodiment containing four valves and two panel type electron extractors as part of the independent electron extraction units.
Figure 3B:
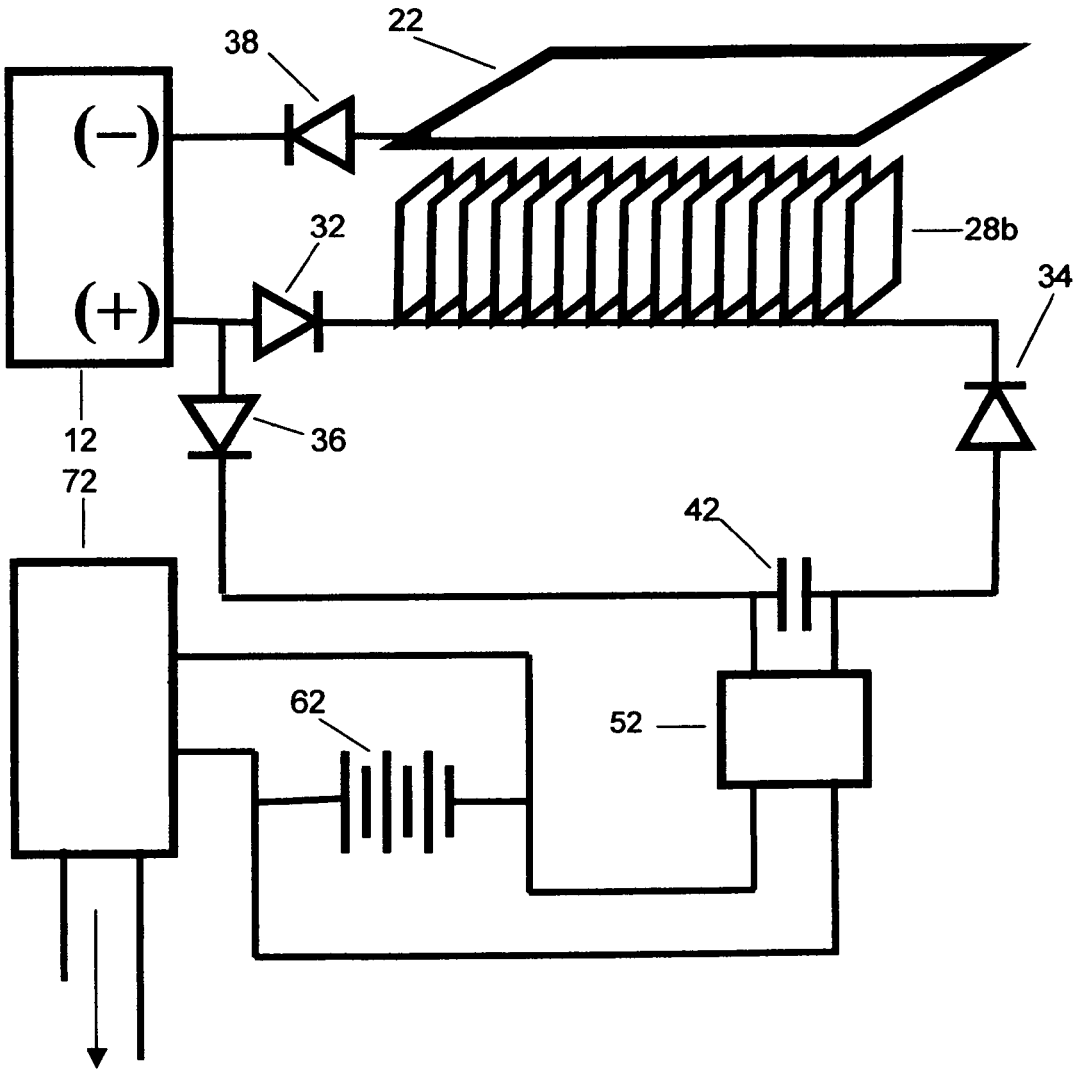
FIG. 3B shows another variation of the embodiment containing four valves with a panel type electron extractor, a charge control unit, an inverter and an electric storage device has been added.

FIGS. 1B, 2B and 3B—Variations of Another Embodiment

Figure 3C:
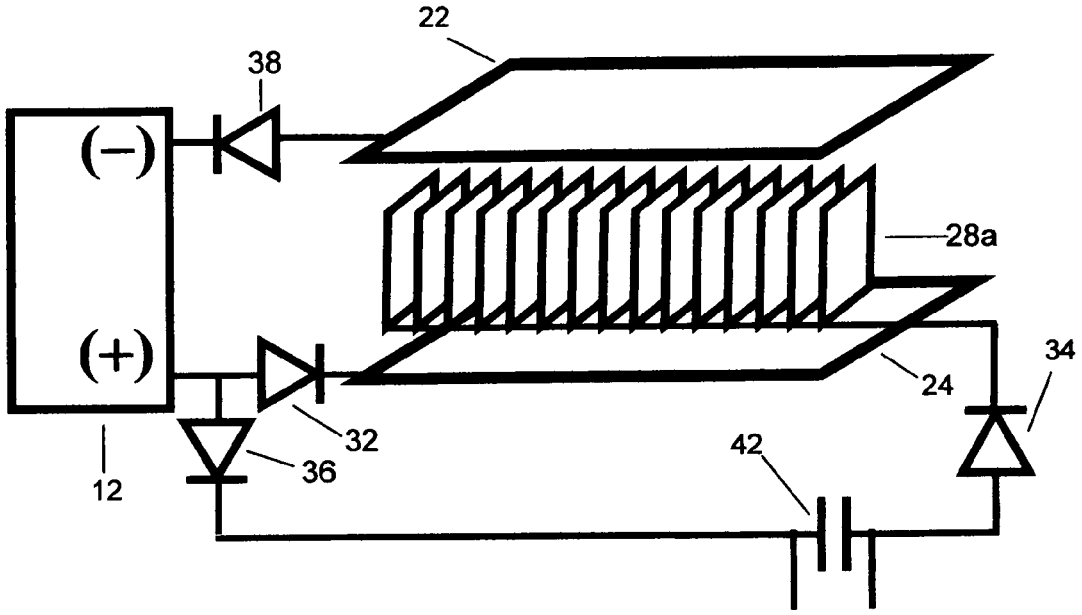
FIG. 3C shows another variation of the embodiment with four valves and an electron extraction unit containing two field plates and a panel type extractor.

In several of the subsequent figures, panel type extractor components are shown in place of the grid type or pane type previously shown. The panel type extractor consists of multiple individual conductive panels connected by a common conductor and arranged in an assembly with one next to another leaving a minimal space between every panel so that the particles subject to ionization may pass in between. The number of panels contained in an assembly is subject to the implementation. An example of the single function panel type extractor, part 28*a*, is shown in FIG. 3C. A dual function panel type positive field plate extractor, part 28*b*, is shown in FIGS. 1B, 2B and 3B. In the figures, flat panels are aligned vertically and arranged parallel to the flow of the object particles. From the perspective shown, the target particles are guided from the backside and exit to the front as ions. However, the panels may be aligned in many alternate orientations, for example, diagonally as seen from the front or diagonally as seen from the top, or both. And subject to the implementation, they may also take many shapes and of various sizes as flat panels. They may also incorporate many three-dimensional shapes such as concave bowls or have 'C' or 'S' curves, or provided with 'V' or 'Z' bends as additional examples. In certain embodiments the shaping of the panels increases flow control of target particles between the panels and increases the probability of contact between the target particles and panel surfaces.

DESCRIPTION

FIG. 1B

FIG. 1B shows the basic components of a variation of another embodiment coupled with a schematic diagram indicating their relative position within an electronic circuit. The components include a power source, part 12, which is connected to the negative field plate, part 22. Through the other terminal, the power source is connected to the panel type positive field plate, part 28*b*, a panel type electron extractor with the capacity to ionize particles and produce free electrons. The panel assembly is connected to two valves that include, part 32, which connects the panel, part 28*b*, to the power source, part 12, while the valve, part 34, also connects the panel 28*b* to the charge collector, part 42. Both valves are represented by diodes. The power source, part 12, also connects to the positive terminal of the collector, part 42. The positive charge established there attracts the extracted electrons to the negative terminal of the collector. This figure differs from FIG. 1A with of a single panel type extractor positive field plate 28*b* in place of the single grid type of or the single pane type of FIG. 7A.

OPERATION

FIG. 1B

The basic operation of FIG. 1B is as that of the previous figure. From the perspective shown, the target atoms and molecules of air or other gas are guided to the backside of the panel assembly 28*b* and exit through the front as ions. While the target particles pass through the gap and along the surface of the panels, the close encounter or contact with the atoms of the panel material results in the extraction and capture of one or more electrons. The captured electrons are in turn repelled from the extractor atoms by the strong negative electric field imposed by the field plate 22. Simultaneously the positive side of the collector 42 attracts the captured electrons, where they accumulate on the negative side, being unable to return to the panel. Considering that the collector 42 represents any number that may be required, a substantial quantity of energy can accumulate over very short periods of time. The energy is thus immediately available for use in a variety of applications. As can be seen, by maintaining the respective electric charge upon the negative field plate 22, the positive panel type extractor 28*b* and the positive side of the collector 42 and placing the embodiment in an environment containing air or other gas that moves through the panel assembly, a continuous supply of electric energy is produced, collected and made ready for use in a variety of systems. Additionally, the process functions as described above in FIG. 1A.

DESCRIPTION

FIG. 2B

FIG. 2B shows another variation of the basic components of the previous embodiment coupled with a schematic diagram indicating their relative position within an electronic circuit. The components include a power source, part 12, which is connected through valve 38 to two negative field plates, part 22. Through the other terminal, the power source is connected to two panel type assembly extractor positive field plates, part 28*b*, each a panel type electron extractor with the capacity to ionize particles and produce free electrons. The panels are connected to two valves that include, part 32, which connects the panels, part 28*b*, to the power source, part 12, while the valve, part 34, also connects the panels 28*b* to the charge collector, part 42. The four valves shown in the figure are represented by diodes. Through valve 36, the power source, part 12, also connects to the positive terminal of the collector, part 42. The positive charge established there attracts the extracted electrons to the negative terminal of the collector. This figure differs from the previous with the addition of a second panel type electron extraction unit consisting of parts 22 and 28*b*, and two valves, parts 36 and 38.

OPERATION

FIG. 2B

The basic operation of FIG. 2B is as that of the previous figure. From the perspective shown, the target atoms and molecules of air or other gas are guided to the backside of each panel assembly 28*b* and exit through the front as ions. While the target particles pass through the gap and along the surface of the panels, the close encounter or contact with the atoms of the panel material results in the extraction and capture of one or more electrons. The captured electrons are in turn repelled from the extractor atoms by the strong negative electric field imposed by each field plate 22. Simultaneously the positive side of the collector 42 attracts the captured electrons, where they accumulate on the negative side, being unable to return to the panel. Considering that the collector 42 represents any number that may be required, a substantial quantity of energy can accumulate over very short periods of time. The energy is thus immediately available for use in a variety of applications. As can be seen, by maintaining the respective electric charge upon each negative field plate 22, each positive panel 28*b* and the positive side of the collector 42 and placing the embodiment in an environment containing air or other gas that moves through the panel assembly, a continuous supply of electric energy is produced, collected and made ready for use in a variety of systems. The figure shows that additional electron extraction units can be added to satisfy the requirements of any implementation. Additionally, the process functions as described above in FIG. 1A.

DESCRIPTION

FIG. 3B

FIG. 3B shows another variation of the basic components of the previous embodiment coupled with a schematic diagram indicating their relative position within an electronic circuit. The components include a power source, part 12, which is connected through valve, part 38, to the negative field plate, part 22. Through the other terminal, the power source is connected to the panel type positive field plate, part 28*b*, a single panel type electron extractor with the capacity to ionize particles and produce free electrons. The extractor is connected to two valves that include, part 32, which connects the panel assembly 28*b* to the power source 12, while the valve, part 34, connects it to the charge collector, part 42. Both valves are represented by diodes. The power source, part 12, also connects through valve, part 36, to the positive terminal of the collector, part 42. The positive charge established there attracts the extracted electrons from the panel to the negative terminal of the collector 42. With the addition of the charge control unit, part 52, the electric energy accumulated by the collector 42 can be distributed in the required quantity. As shown here the control unit 52 distributes the energy to the inverter, part 72. The inverter 72 converts the electric energy into the required form, specifically the voltage and as necessary the required frequency. To increase storage capacity, an electric storage unit, part 62, has been added. This figure differs from the previous by the elimination of one EEU and the addition of the control unit 52, electric storage unit 62, and the inverter unit 72.

OPERATION

FIG. 3B

The basic operation of FIG. 3B is as that of FIG. 6A. From the perspective shown, the target atoms and molecules of air or other gas are guided to the backside of the panel assembly 28*b* and exit through the front as ions. While the target particles are passing between the panels, the close encounter or contact with the atoms of the panel material results in the extraction and capture of one or more electrons. The captured electrons are in turn repelled from the panel atoms by the strong negative electric field imposed by the field plate 22. Simultaneously the positive side of the collector 42 attracts the captured electrons, where they accumulate, being unable to return to the panel assembly. Considering that the collector 42 represents any number that may be required, a substantial quantity of energy can accumulate over very short periods of time. The addition of valve 36 prevents the return of electrons to the positive terminal of the collector 42. Similarly, the addition of valve 38 prevents the electrons established upon the negative field plate 22 from returning to the power source 12. As shown here the control unit 52 distributes the collected energy to the inverter unit 72. However, an electric storage unit 62 has been added to increase the capacity. Although a single electric storage unit 62 is shown, it is representative of a group consisting of any quantity that may be required by an implementation. The inverter 72 converts the electric energy into the required form. For example, direct current (DC) can be converted to a required voltage and frequency such as 120V alternating current (AC) at 60 Hz. The energy is thus immediately available for use in a variety of applications. As can be seen, by maintaining the respective electric charge upon the negative field plate 22, the positive panel type extractor 28*b* and the positive side of the collector 42 and placing the embodiment in an environment containing air or other gas that moves in between the panels, a continuous supply of electric energy is produced, collected and made ready for use in a variety of systems. Additionally, the process functions as described above in FIG. 1A.

DETAILED DESCRIPTION

FIGS. 1C, 2C, 3C, 4C and 5C—Variations of Another Embodiment

In the figures that follow single function grid type, pane type and panel type extractor components are shown, where in the previous groups of figures, dual function extractor components were shown. The single function extractor components are physically independent from the positive terminal of the power source 12.

DESCRIPTION

FIG. 1C

Figure 1C:
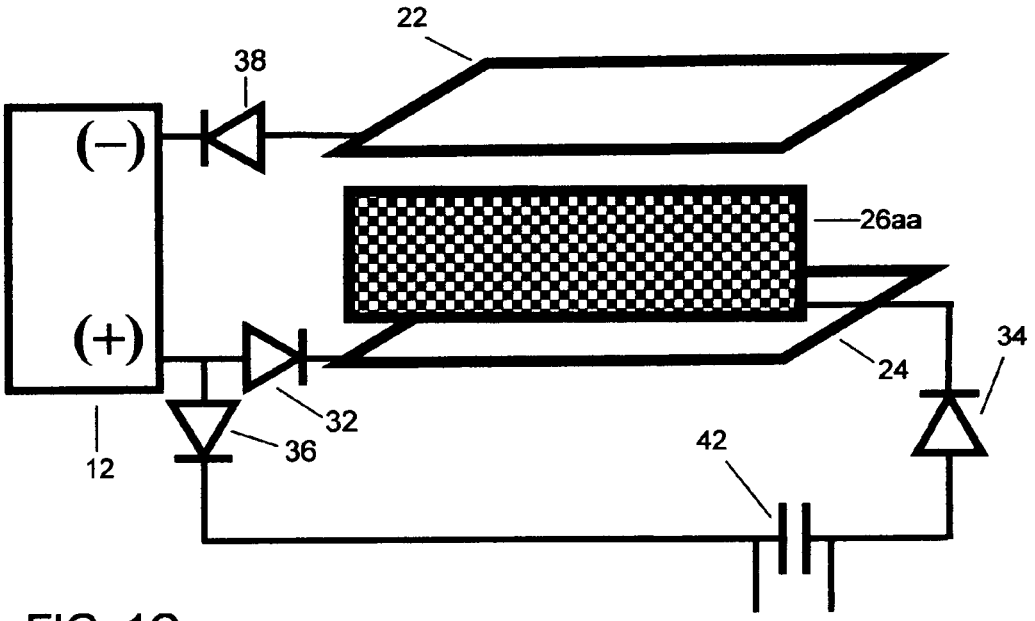
FIG. 1C shows one variation of another embodiment with four valves with an electron extraction unit containing two field plates and a single grid type extractor.

FIG. 1C shows another variation of the basic components of another embodiment coupled with a schematic diagram indicating their relative position within an electronic circuit. This embodiment differs from the previous groups in that the grid type extractor and positive field plate are separate parts, resulting with two components where previously they were incorporated into one. The separate components include the positive field plate, part 24, and the grid type electron extractor, part 26*aa*. The components include a power source, part 12, the negative terminal of which connects through valve, part 38, to the negative field plate, part 22. The other terminal of the power source connects through valve, part 32, to the positive field plate, part 24. The power source 12 also connects through valve 36 to the positive terminal of the collector, part 42. The grid, being independent of both field plates, 22 and 24, connects through valve, part 34, to the negative terminal of the charge collector, part 42. The four valves are represented by diodes. The positive charge established on the positive side of the collector 42 attracts the valance and extracted and captured electrons from the grid to the negative terminal of the collector 42. The primary difference between this figure and those of the previous groups relates to grid 26*aa*, the electron extractor, being physically independent from the positive field plate 24.

OPERATION

FIG. 1C

The basic operation of FIG. 1C is similar as that described in FIG. 6A. As the power source 12 is activated, equal to the electric potential difference, valance electrons are detached from the atoms of the positive field plate 24 establishing a positive electric field there, and the electrons are transferred to the negative field plate 22 establishing a negative electric field there. Furthermore the valance electrons of the grid atoms are repelled by the negative field plate 22 and are attracted to the positive field plate 24, while at the same time they are attracted by the positive charge established on the collector 42. From the perspective shown, the target atoms and molecules of air or other gas are guided to the backside of grid 26*aa* and exit through the front as ions. While the target particles are passing through the grid 26*aa*, the close encounter or contact with the atoms of the grid material results in the extraction and capture of one or more electrons. Remaining valance electrons and the subsequent captured electrons are in turn repelled from the grid atoms by the strong negative electric field imposed by the field plate 22. These electrons are at the same time attracted towards the positive field plate 24 by the strong positive electric field placed there. Simultaneously the strong positive charge on the positive terminal of the collector 42 attracts both the valance and captured electrons from the grid 26*aa* to the negative terminal. The collector 42 represents any quantity that may be required by an implementation. As can be seen, valve 32 allows electrons to move from the positive field plate 24 and prevents their return. And valve 38 allows electrons to be deposited on the negative field plate 22 and prevents their escape and return to the power source 12. Valve 34 allows electrons to move from the grid 26*aa* to the negative side of the collector 42 and prevents their return. Valve 36 allows electrons to move from the positive terminal of the collector 42 and prevents their return. The energy is thus immediately available for use in a variety of applications. As can be seen, by maintaining the respective electric charge upon the negative field plate 22, the positive field plate 24 and the positive side of the collector 42 and placing the embodiment in an environment containing air or other gas that moves through the grid, a continuous supply of electric energy is produced, collected and made ready for use in a variety of systems. Additionally, the process functions as described above in FIGS. 1A and 6A.

DESCRIPTION

FIG. 2C

Figure 2C:
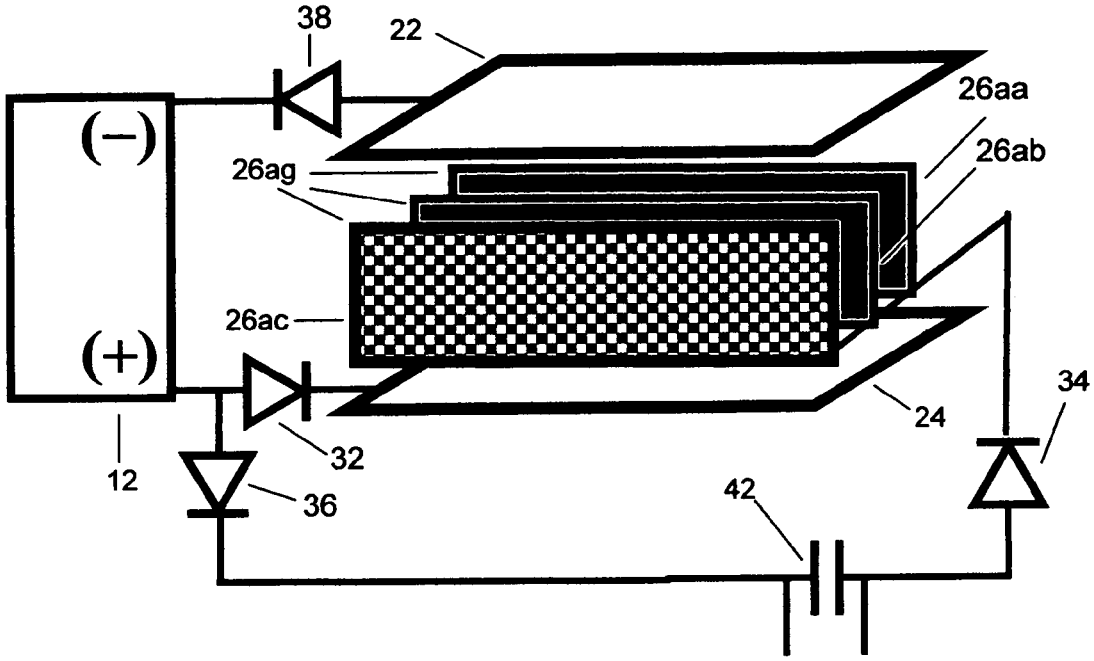
FIG. 2C shows another variation of the embodiment with four valves and an electron extraction unit containing two field plates with an assembly of three grid type extractors.

FIG. 2C shows another variation of the basic components of the previous embodiment coupled with a schematic diagram indicating their relative position within an electronic circuit. This embodiment differs from the previous groups in that the grid type extractor assembly and positive field plate are separate parts, resulting with two components where previously they were incorporated into one. The separate components include the positive field plate, part 24, and the grid type extractor assembly, part 26*ag*. The grid assembly consists of three grids, 26*aa*, 26*ab* and 26*ac*, although the actual quantity in other examples will be determined by the requirements of the implementation. The components include a power source, part 12, the negative terminal of which connects through valve, part 38, to the negative field plate, part 22. The other terminal of the power source connects through valve, part 32, to the positive field plate, part 24. The power source 12 also connects through valve 36 to the positive terminal of the collector, part 42. The grid assembly 26*ag*, being independent of both field plates, 22 and 24, connects through valve, part 34, to the negative terminal of the charge collector, part 42. The four valves are represented by diodes. The positive charge established on the positive side of the collector 42 attracts the valance and extracted electrons from the grid to the negative terminal of the collector 42. The primary difference between this figure and those of previous groups relates to grid assembly 26*ag*, the electron extractor, being physically independent from the positive field plate 24.

OPERATION

FIG. 2C

The basic operation of FIG. 2C is as that described in FIGS. 2A and 1C. As the power source 12 is activated, equal to the electric potential difference, valance electrons are detached from the atoms of the positive field plate 24 establishing a positive electric field there, and the electrons are transferred to the negative field plate 22 establishing a negative electric field there. Furthermore the valance electrons of the grid atoms are repelled by the negative field plate 22 and are attracted to the positive field plate 24, while at the same time they are attracted by the positive charge established on the collector 42. From the perspective shown, the target atoms and molecules of air or other gas are guided to the backside of grid assembly 26*ag* and exit through the front as ions. While the target particles are passing through the grid assembly 26*ag*, the close encounter or contact with the atoms of the grid material results in the extraction and capture of one or more electrons. Remaining valance electrons and the subsequent captured electrons are in turn repelled from the grid atoms by the strong negative electric field imposed by the field plate 22. These electrons are at the same time attracted towards the positive field plate 24 by the strong positive electric field placed there. Simultaneously the strong positive charge on the positive terminal of the collector 42 attracts both the valance and captured electrons from the grid assembly 26*ag* to the negative terminal. The collector 42 represents any quantity that may be required by an implementation. As can be seen, valve 32 allows electrons to move from the positive field plate 24 and prevents their return. And valve 38 allows electrons to be deposited on the negative field plate 22 and prevents their escape and return to the power source 12. Valve 34 allows electrons to move from the grid assembly 26*ag* to the negative side of the collector 42 and prevents their return. Valve 36 allows electrons to move from the positive terminal of the collector 42 and prevents their return. The energy is thus immediately available for use in a variety of applications. As can be seen, by maintaining the respective electric charge upon the negative field plate 22, the positive field plate 24 and the positive side of the collector 42 and placing the embodiment in an environment containing air or other gas that moves through the grid, a continuous supply of electric energy is produced, collected and made ready for use in a variety of systems. Additionally, the process functions as described above in FIG. 1A.

DESCRIPTION

FIG. 3C

FIG. 3C shows another variation of the basic components of the previous embodiment coupled with a schematic diagram indicating their relative position within an electronic circuit. This embodiment differs from the previous groups in that the panel type extractor and positive field plate are separate parts, resulting with two components where previously they were incorporated into one. The separate components include the positive field plate, part 24, and the panel type electron extractor, part 28*a*, an assembly of multiple panels. The components include a power source, part 12, the negative terminal of which connects through valve, part 38, to the negative field plate, part 22. The other terminal of the power source connects through valve, part 32, to the positive field plate, part 24. The power source 12 also connects through valve 36 to the positive terminal of the collector, part 42. The panel assembly 28*a*, being independent of both field plates, 22 and 24, connects through valve, part 34, to the negative terminal of the charge collector, part 42. The four valves are represented by diodes. The positive charge established on the positive side of the collector 42 attracts the valance and extracted electrons from the grid to the negative terminal of the collector 42. The primary difference between this figure and those of the previous groups relates to the panel type electron extractor 28*a* being physically independent from the positive field plate 24.

OPERATION

FIG. 3C

The basic operation of FIG. 3C is as that described in FIG. 2B. As the power source 12 is activated, equal to the electric potential difference, valance electrons are detached from the atoms of the positive field plate 24 establishing a positive electric field there, and the electrons are transferred to the negative field plate 22 establishing a negative electric field there. Furthermore the valance electrons of the grid atoms are repelled by the negative field plate 22 and are attracted to the positive field plate 24, while at the same time they are attracted by the positive charge established on the collector 42. From the perspective shown, the target atoms and molecules of air or other gas are guided to the backside of the panel assembly 28*a* and exit through the front as ions. While the target particles are passing between the panels, the close encounter or contact with the atoms of the panel material results in the extraction and capture of one or more electrons. Remaining valance electrons and the subsequent captured electrons are in turn repelled from the panel atoms by the strong negative electric field imposed by the field plate 22. These electrons are at the same time attracted towards the positive field plate 24 by the strong positive electric field placed there. Simultaneously the strong positive charge on the positive terminal of the collector 42 attracts both the valance and captured electrons from the panel assembly 28*a* to the negative terminal. The collector 42 represents any quantity that may be required by an implementation. As can be seen, valve 32 allows electrons to move from the positive field plate 24 and prevents their return. And valve 38 allows electrons to be deposited on the negative field plate 22 and prevents their escape and return to the power source 12. Valve 34 allows electrons to move from the panel assembly 28*a* to the negative side of the collector 42 and prevents their return. Valve 36 allows electrons to move from the positive terminal of the collector 42 and prevents their return. The energy is thus immediately available for use in a variety of applications. As can be seen, by maintaining the respective electric charge upon the negative field plate 22, the positive field plate 24 and the positive side of the collector 42 and placing the embodiment in an environment containing air or other gas that moves through the panel assembly, a continuous supply of electric energy is produced, collected and made ready for use in a variety of systems. Additionally, the process functions as described above in FIGS. 1A and 1B.

DESCRIPTION

FIG. 4C

Figure 4C:
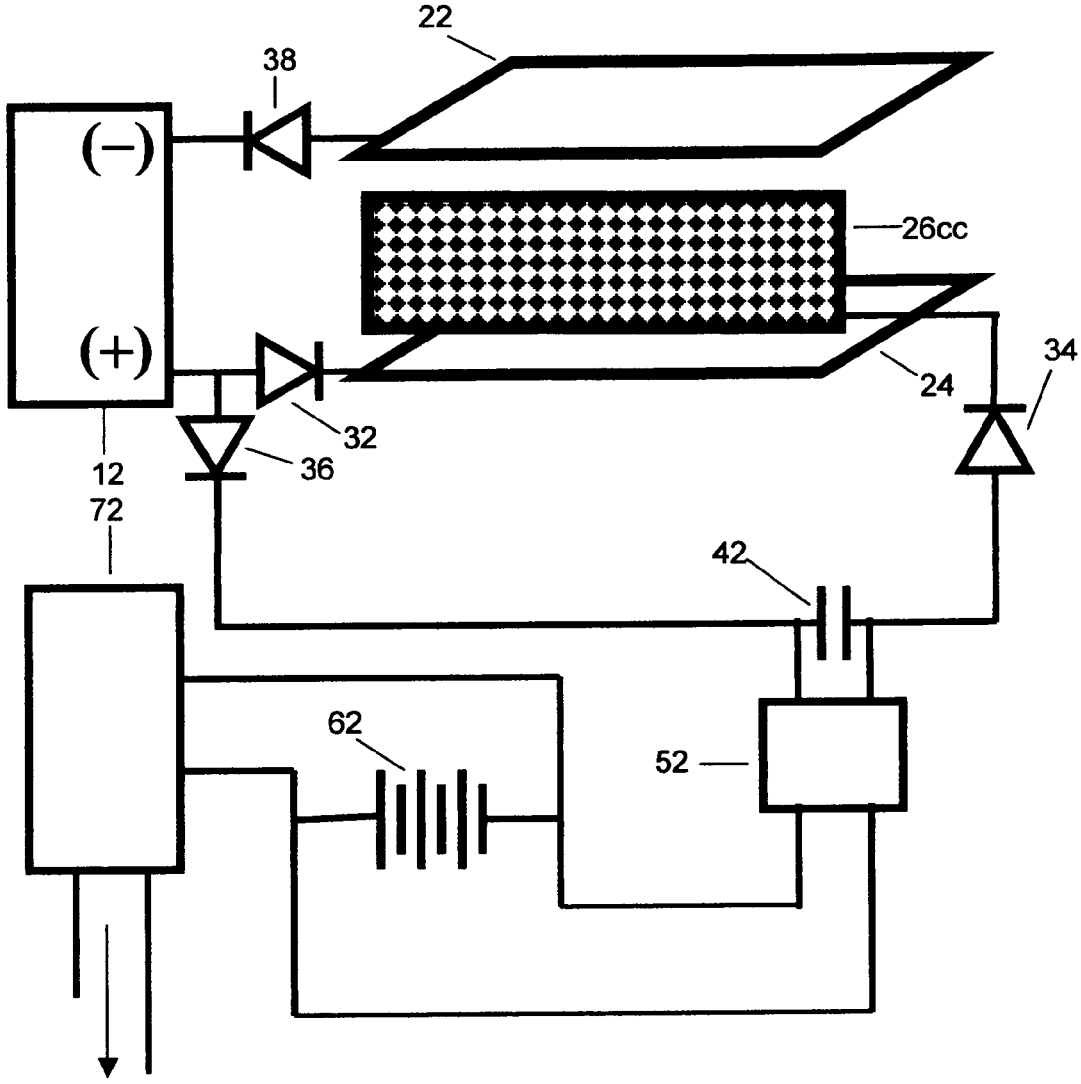
FIG. 4C shows another variation of the embodiment with four valves, a charge control unit, an inverter and an electric storage device has been added with an electron extraction unit containing two field plates and a grid type extractor.

FIG. 4C shows another variation of the basic components of the previous embodiment coupled with a schematic diagram indicating their relative position within an electronic circuit. This embodiment differs from the previous groups in that the pane type extractor and positive field plate are separate parts, resulting with two components where previously they were incorporated into one. The separate components include the positive field plate, part 24, and the pane type electron extractor, part 26*cc*. The components include a power source, part 12, the negative terminal of which connects through valve, part 38, to the negative field plate, part 22. The other terminal of the power source connects through valve, part 32, to the positive field plate, part 24. The power source 12 also connects through valve 36 to the positive terminal of the collector, part 42. The perforated pane 26*cc*, being independent of both field plates, 22 and 24, connects through valve, part 34, to the negative terminal of the charge collector, part 42. The four valves are represented by diodes. The positive charge established on the positive side of the collector 42 attracts the valance and extracted electrons from the pane type extractor to the negative terminal of the collector 42. With the addition of the charge control unit, part 52, the electric energy accumulated by the collector 42 can be distributed in the required quantity. As shown here the control unit 52 distributes the energy to the inverter, part 72. The inverter 72 converts the electric energy into the required form, specifically the voltage required frequency. To increase storage capacity, an electric storage unit, part 62, has been added. The primary difference between this figure and those of the previous groups relates to pane 26*cc*, the electron extractor, being physically independent from the positive field plate 24.

OPERATION

FIG. 4C

The basic operation of FIG. 4C is as that described in FIG. 6A. As the power source 12 is activated, equal to the electric potential difference, valance electrons are detached from the atoms of the positive field plate 24 establishing a positive electric field there, and the electrons are transferred to the negative field plate 22 establishing a negative electric field there. Furthermore the valance electrons of the grid atoms are repelled by the negative field plate 22 and are attracted to the positive field plate 24, while at the same time they are attracted by the positive charge established on the collector 42. From the perspective shown, the target atoms and molecules of air or other gas are guided to the backside of pane 26*cc* and exit through the front as ions. While the target particles are passing through the pane 26*cc*, the close encounter or contact with the atoms of the pane material results in the extraction and capture of one or more electrons. Remaining valance electrons and the subsequent captured electrons are in turn repelled from the pane atoms by the strong negative electric field imposed by the field plate 22. These electrons are at the same time attracted towards the positive field plate 24 by the strong positive electric field placed there. Simultaneously the strong positive charge on the positive terminal of the collector 42 attracts both the valance and captured electrons from the pane 26*cc* to the negative terminal. The collector 42 represents any quantity that may be required by an implementation. As can be seen, valve 32 allows electrons to move from the positive field plate 24 and prevents their return. And valve 38 allows electrons to be deposited on the negative field plate 22 and prevents their escape and return to the power source 12. Valve 34 allows electrons to move from the pane 26*cc* to the negative side of the collector 42 and prevents their return. Valve 36 allows electrons to move from the positive terminal of the collector 42 and prevents their return. As shown here the control unit 52 distributes the collected energy to the inverter unit 72. However, an electric storage unit 62 has been added to increase the capacity. Although a single electric storage unit 62 is shown, it is representative of a group consisting of any quantity that may be required by an implementation. The inverter 72 converts the electric energy into the required form. For example, direct current (DC) can be converted to a required voltage and frequency such as 120V alternating current (AC) at 60 Hz. The energy is thus immediately available for use in a variety of applications. As can be seen, by maintaining the respective electric charge upon the negative field plate 22, the positive field plate 24 and the positive side of the collector 42 and placing the embodiment in an environment containing air or other gas that moves through the pane, a continuous supply of electric energy is produced, collected and made ready for use in a variety of systems. Additionally, the process functions as described above in FIGS. 1A and 6A.

DESCRIPTION

FIG. 5C

FIG. 5C shows another variation of the basic components of the previous embodiment coupled with a schematic diagram indicating their relative position within an electronic circuit. This embodiment differs from the previous groups in that the grid type extractor and positive field plate are separate parts, resulting with two components where previously they were incorporated into one. The separate components include the positive field plate, part 24, and the grid type electron extractor, part 26*aa*. The components include a power source, part 12, the negative terminal of which connects through valve, part 38, to the negative field plate, part 22. The other terminal of the power source connects through valve, part 32, to the positive field plate, part 24. The power source 12 also connects through valve 36 to the positive terminal of the collector, part 42. The grid 26*aa*, being independent of both field plates, 22 and 24, connects through valve, part 34, to the negative terminal of the charge collector, part 42. The four valves are represented by diodes. The positive charge established on the positive side of the collector 42 attracts the valance and extracted electrons from the grid type extractor to the negative terminal of the collector 42. With the addition of the charge control unit, part 52, the electric energy accumulated by the collector 42 can be distributed in the required quantity. As shown here the control unit 52 distributes the energy to the inverter, part 72. The inverter 72 converts the electric energy into the required form, specifically the voltage and frequency. To increase storage capacity, an electric storage unit, part 62, has been added. Also an ion diverter, part 44 and the diverter charge plate, part 46, have been added. The charge plate induces a bias voltage onto the diverter, which attracts the newly formed ions away from the grid. The primary difference between this figure and those of the previous groups relates to grid 26*aa*, the electron extractor, being physically independent from the positive field plate 24.

OPERATION

FIG. 5C

The basic operation of FIG. 5C is as that described in FIG. 6A. As the power source 12 is activated, equal to the electric potential difference, valance electrons are detached from the atoms of the positive field plate 24 establishing a positive electric field there, and the electrons are transferred to the negative field plate 22 establishing a negative electric field there. Furthermore the valance electrons of the grid atoms are repelled by the negative field plate 22 and are attracted to the positive field plate 24, while at the same time they are attracted by the positive charge established on the collector 42. From the perspective shown, the target atoms and molecules of air or other gas are guided to the backside of grid 26*aa* and exit through the front as ions. While the target particles are passing through the grid 26*aa*, the close encounter or contact with the atoms of the grid material results in the extraction and capture of one or more electrons. Remaining valance electrons and the subsequent captured electrons are in turn repelled from the grid atoms by the strong negative electric field imposed by the field plate 22. These electrons are at the same time attracted towards the positive field plate 24 by the strong positive electric field placed there. Simultaneously the strong positive charge on the positive terminal of the collector 42 attracts both the valance and captured electrons from the grid 26*aa* to the negative terminal. The collector 42 represents any quantity that may be required by an implementation. As can be seen, valve 32 allows electrons to move from the positive field plate 24 and prevents their return. And valve 38 allows electrons to be deposited on the negative field plate 22 and prevents their escape and return to the power source 12. Valve 34 allows electrons to move from the grid 26*aa* to the negative side of the collector 42 and prevents their return. Valve 36 allows electrons to move from the positive terminal of the collector 42 and the diverter charge plate, part 46, and prevents their return. As shown here the control unit 52 distributes the collected energy to the inverter unit 72. However, an electric storage unit 62 has been added to increase the capacity. Although a single electric storage unit 62 is shown, it is representative of a group consisting of any quantity that may be required by an implementation. The inverter 72 converts the electric energy into the required form. For example, direct current (DC) can be converted to a required voltage and frequency such as 120V alternating current (AC) at 60 Hz. The energy is thus immediately available for use in a variety of applications. As can be seen, by maintaining the respective electric charge upon the negative field plate 22, the positive field plate 24 and the positive side of the collector 42 and placing the embodiment in an environment containing air or other gas that moves through the grid, a continuous supply of electric energy is produced, collected and made ready for use in a variety of systems. Additionally, the process functions as described above in FIGS. 1A, 6A and 4C.

ALTERNATIVE EMBODIMENTS

Although the descriptions above show many alternative embodiments, they should not be interpreted as to limit the scope of the embodiments, as they are representations of only a small number of potential embodiments. Furthermore, the primary components of any embodiment may be arranged differently and the components may take on different values, shapes, configurations and specifications from that shown or described herein.

ADVANTAGES

Simplicity, efficiency, adaptability, versatility, low energy consumption, and high productivity are just some of the terms that describe the advantages of the process of the present application. It is an innovative process for the production of electric energy and the production of positive ions. It can operate continuously 24 hours per day without interruption provided the proper electric charge is maintained upon each of the three primary components that include the negative field plate, the dual function extractor or positive field plate and the positive side of the collector. Through the process, electric energy can be supplied individually to each structure or demand location making them independent from any other energy source. It can be scaled to accommodate the electric power requirements of many implementations and utilizations that include portable units and units fitted to stationary or portable appliances, devices, apparatus and vehicles.

CONCLUSION, RAMIFICATIONS AND SCOPE

Accordingly, the reader will see that the process of the present application is superior for the extraction and capture of electrons from atoms and molecules, the production of positive ions and electric energy.

What is claimed is:

1. A system for the extraction of electrons from molecules, the system comprising:

a) a power source having a negative terminal and a positive terminal;

b) a parallel plate capacitor comprising:

i. a negative field plate, the negative field plate connected to the negative terminal of the power source; and ii. a grid, comprising a positive field plate, the positive field plate having a first end and a second end;

c) a first valve having a first end and a second end, the first end connected to the positive terminal of the power source and the second end of the first valve connected to the first end of the positive field plate;

d) a charge collector having a positive terminal and a negative terminal with the positive terminal connected between the positive terminal of the power source and the first valve;

e) a second valve comprising a first end and a second end with the second valve first end connected to the negative terminal of the charge collector and the second end of the second valve connected to the second end of the positive field plate; and f) the first and second valves comprising one way mechanisms wherein electrons may flow from the first end to the second end only.

2. The system of claim 1 wherein the grid further comprises a dual function positive field plate and grid type extractor.

3. The system of claim 2 wherein the grid comprises adjustable apertures.

4. The system of claim 1 wherein the first and second valves comprise diodes.

5. A method of extracting electrons from molecules, the method comprising:

a) using a power source having a negative terminal and a positive terminal;

b) using a negative field plate connected to the negative terminal of the power source;

c) using a first valve with a first end and a second end and connecting the positive terminal of the power source to the first end of the first valve and connecting the second end of the first valve to a first end of a positive field plate;

d) using a collector having a positive terminal and a negative terminal by connecting the positive terminal of the collector between the positive terminal of the power source and the first valve and by connecting the negative terminal of the collector to a first end of a second valve;

e) connecting a second end of the second valve to a second end of the positive field plate;

f) wherein the first and second valves comprise one way mechanisms so that electrons may flow from the first end to the second end only.

6. The method of claim 5 further comprising the step of activating the power source to remove electrons from the collector and to transfer the electrons to the negative field plate.

7. The method of claim 5 further comprising the step of using diodes for the first and second valves.

8. The method of claim 5 further comprising the step of using the positive field plate and the negative field plate as a parallel plate capacitor.

9. The method of claim 8 further comprising the step of using the parallel plate capacitor as a first capacitor and using the collector as a second capacitor.

10. The method of claim 5 further comprising the step of using a positive field plate comprising a system of adjustable apertures.

* * * * *